US009783406B2

(12) United States Patent
Törngren

(10) Patent No.: US 9,783,406 B2
(45) Date of Patent: Oct. 10, 2017

(54) DISPENSING DEVICE

(71) Applicant: Identic AB, Vallentuna (SE)

(72) Inventor: Mats Törngren, Stockholm (SE)

(73) Assignee: Identic AB, Vallentuna (SE)

( * ) Notice: Subject to any disclaimer, the term of this patent is extended or adjusted under 35 U.S.C. 154(b) by 0 days.

(21) Appl. No.: 15/120,382

(22) PCT Filed: Feb. 23, 2015

(86) PCT No.: PCT/SE2015/050202
§ 371 (c)(1),
(2) Date: Aug. 19, 2016

(87) PCT Pub. No.: WO2015/130208
PCT Pub. Date: Sep. 3, 2015

(65) Prior Publication Data

US 2017/0066644 A1 Mar. 9, 2017

(30) Foreign Application Priority Data

Feb. 26, 2014 (SE) ..... 1450222

(51) Int. Cl.
*B67D 7/42* (2010.01)
*B67D 7/02* (2010.01)
*B67D 7/04* (2010.01)

(52) U.S. Cl.
CPC ..... *B67D 7/42* (2013.01); *B67D 7/0294* (2013.01); *B67D 7/04* (2013.01)

(58) Field of Classification Search
CPC ..... B67D 7/04; B67D 7/0288; B67D 7/0294; B67D 7/42; B67D 7/50
(Continued)

(56) References Cited

U.S. PATENT DOCUMENTS 3,086,565 A * 4/1963 Mosher ..... B64D 39/04 141/347
3,168,125 A * 2/1965 Rosell ..... F16L 37/16 137/614.06

(Continued)

FOREIGN PATENT DOCUMENTS

CA 2729413 A1 7/2011
CN 1628072 A 6/2005

(Continued)

OTHER PUBLICATIONS

International Search Report and Written Opinion received for PCT Patent Application PCT/SE2015/050202, dated May 13, 2015, 11 pages.

(Continued)

*Primary Examiner* — Nicolas A Arnett
(74) *Attorney, Agent, or Firm* — Morrison & Foerster LLP

(57) ABSTRACT

A dispensing device which ensures that a dispensing procedure cannot be initiated unless a firm coupling to a male coupling of a recipient is achieved is disclosed. The dispensing device comprises a coupling body, an inner flow sleeve, a release sleeve, at least one locking element arranged in a radial opening of the coupling body and a retaining collar axially movable between a first and second position. The dispensing device further comprises means for allowing axial movement of the release sleeve towards the dispensing end of the gun, and may comprise means for allowing axial movement of the inner flow sleeve away from the dispensing end of the device, when the retaining collar is in the second position.

18 Claims, 11 Drawing Sheets

(58) Field of Classification Search
USPC ..... 141/346, 348–350, 383–384, 392
See application file for complete search history.

(56) References Cited

U.S. PATENT DOCUMENTS

| | | | | |
|---|---|---|---|---|
| 3,176,727 | A * | 4/1965 | Rousseau | B65B 31/003 141/177 |
| 5,634,505 | A * | 6/1997 | Wong | B67D 7/005 137/614.05 |
| 5,755,256 | A | 5/1998 | Elsdon | |
| 7,543,611 | B2 * | 6/2009 | Kallberg | B67D 7/46 141/1 |
| 8,033,305 | B2 * | 10/2011 | Weh | F17C 13/00 141/206 |
| 8,863,791 | B2 * | 10/2014 | Aehle | F17C 5/02 141/198 |
| 9,334,992 | B2 * | 5/2016 | Blanchard | F17C 13/04 |
| 2003/0178096 | A1 | 9/2003 | Lacroix et al. | |
| 2006/0174971 | A1 * | 8/2006 | Kallberg | G01F 23/686 141/198 |
| 2007/0163673 | A1 * | 7/2007 | Kallberg | B60K 15/04 141/383 |
| 2008/0223486 | A1 * | 9/2008 | Weh | B67D 7/50 141/392 |
| 2011/0186176 | A1 * | 8/2011 | Aehle | F17C 5/02 141/350 |
| 2013/0327439 | A1 * | 12/2013 | Pitney | F16L 37/0848 141/346 |

FOREIGN PATENT DOCUMENTS

| | | | |
|---|---|---|---|
| CN | 101274312 | A | 10/2008 |
| CN | 101410322 | A | 4/2009 |
| CN | 101516522 | A | 8/2009 |
| DE | 202004011088 | U1 | 8/2005 |
| EP | 1346946 | A1 | 9/2003 |
| EP | 1847757 | A1 | 10/2007 |
| GB | 2068069 | A | 8/1981 |
| WO | 03080500 | A1 | 10/2003 |

OTHER PUBLICATIONS

International Preliminary Report on Patentability received for PCT Patent Application No. PCT/SE2015/050202, dated Sep. 9, 2016, 9 pages.

Office Action received for Chinese Patent Application No. 201580010376.3, dated May 18, 2017, 5 pages. (See Communication under 37 CFR § 1.98(a) (3)).

* cited by examiner

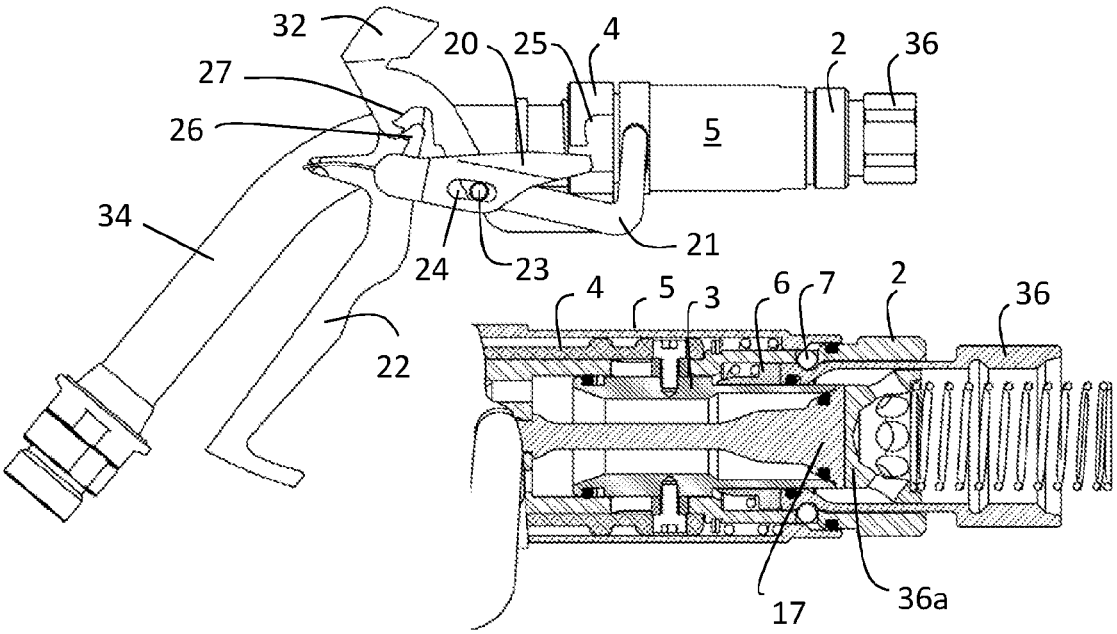
Fig. 5g
Fig. 6a
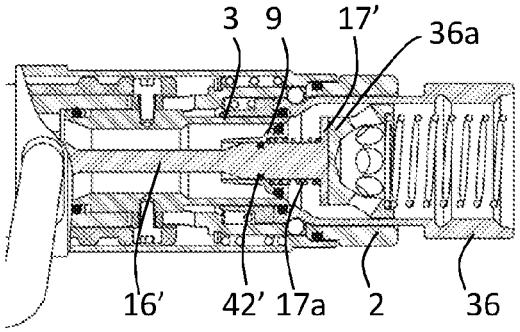
Fig. 6b
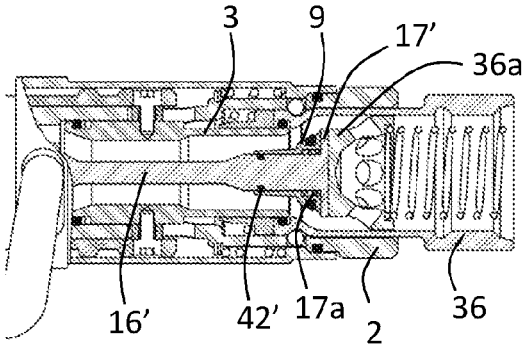

DISPENSING DEVICE

CROSS-REFERENCE TO RELATED APPLICATION

This application is a U.S. National Stage patent application of PCT/SE2015/050202 filed on Feb. 23, 2015, the entire contents of which are incorporated herein by reference.

TECHNICAL FIELD

The present disclosure relates in general to a dispensing device, such as a liquid dispensing device, adapted to be coupled to a coupling of a recipient of the media to be dispensed. More specifically, it relates in general to a dispensing device ensuring a liquid tight coupling to a coupling of a recipient.

BACKGROUND

At a typical refuelling station or other refuelling system, fuel is pumped from a storage tank to a recipient, such as a vehicle fuel tank, via a fuel dispenser. A nozzle in the form of a dispensing gun is positioned at the end of the fuel dispenser and may carry out multiple functions, including for example safe and efficient dispensing of fluid, providing automatic shut-off such that the flow of fuel is terminated when the vehicle tank is sufficiently full, preventing improper operation of the dispenser, and enabling the nozzle to be temporarily held in the open/dispensing position.

Conventional dispensing guns for dispensing fuels, such as petrol or diesel, may often suffer from spillage of fuel due to fuel dripping from the delivery tube after the delivery of fuel has been stopped, for example by an automatic shut-off arrangement. Even though this is not desirable and may present a small risk of flammable liquid being subjected to an unprotected environment it is generally acceptable with a small leakage of such fuels.

However, in light of the development of new alternative fuels, even such a small leakage may have a detrimental effect and must be avoided. Therefore, various solutions of dispensing guns comprising for example complex outlet valve arrangements and/or means for securing a liquid tight coupling between the dispensing gun and the recipient of the fuel have been developed in recent times. The outlet valve arrangement and/or said securing means of the dispensing guns ensures that no leakage can occur, for example by ensuring that no liquid can be present outside of the outlet valve of the dispensing gun after a dispensing procedure. This can for example be achieved by ensuring that a dispensing procedure is only possible when a coupling part of the dispensing gun has been firmly coupled to a corresponding coupling part associated with the fuel tank of a vehicle, and that the dispensing gun cannot be released before the outlet valve has been completely closed. The outlet valves are often some type of poppet valve.

It is previously known to provide a liquid tight coupling of a dispensing gun to a male coupling of a recipient by the use of locking balls of a female coupling of the dispensing gun falling into a groove or recess of the male coupling body. However, in such previously known dispensing guns, the locking of the dispensing gun to the male coupling also influence the outlet valve of the dispensing gun such that a flow of liquid to be dispensed is automatically achieved or at least enabled as soon as the coupling is effectuated. However, in some applications, for example public refuelling stations and especially in case the fuel is a highly flammable liquid, there is a need to be able to start, stop and regulate the flow of liquid only after a liquid tight connection is made.

GB 2068069 A discloses an example of such prior art, but in the form of a pipe coupling. The female coupling member includes a valve body and a displaceable sleeve which in a sealing position is designed to seal against the valve body, via a sealing element on the latter. On insertion of a male coupling member into the female coupling member, the sleeve is pushed back by engagement between a surface in the male member and a shoulder on the sleeve. The female coupling member and the male coupling member are locked to each other by means of locking balls. The pipe coupling disclosed in GB 2068069 A however has the drawback that when the female coupling and the male coupling are locked to each other, the flow path is completely open.

SUMMARY

The object of the present invention is to provide a dispensing device which ensures a spill-free and liquid-tight connection before and during a dispensing procedure of a liquid.

The dispensing device according to the present invention is adapted to be coupled to a coupling of a recipient of the medium to be dispensed. Moreover, the dispensing device according to the present invention is primarily intended for dispensing fuels, but can be used for dispensing of any type of liquid. Furthermore, the dispensing device is preferably a dispensing gun.

By means of the dispensing device according to the present invention, it can be assured that a liquid tight connection is secured before the start of a dispensing procedure since it ensures that the dispensing device is held securely in a fluid tight connection with a connector or coupling of a recipient without affecting an outlet valve, more specifically an outlet poppet valve, of the dispensing device. Thus, a flow through an outlet of the dispensing device is not automatically enabled when the dispensing device has been firmly coupled to a connector or coupling of a recipient.

The dispensing device comprises a coupling body arranged at a dispensing end of the dispensing device and being essentially rotational symmetrical around a central axis, an inner flow sleeve concentric with said central axis and arranged radially inside of the coupling body, a release sleeve concentric with said central axis and arranged radially outside of the coupling body, a poppet valve comprising a poppet valve stem and a poppet valve disc. A first essentially axial end surface the inner flow sleeve is adapted to serve as a valve seat for the poppet valve disc. At least one locking element is arranged in a radial opening of the coupling body and in contact with a radial inner surface of the release sleeve. The dispensing device further comprises a retaining collar which is axially movable in relation to the coupling body between at least a first and a second position. The retaining collar is also axially movable in relation to the inner flow sleeve and is guided on a radial outer surface of the inner flow sleeve. The retaining collar is adapted to retain the locking element, preferably essentially tangent to a radial inner surface of the coupling body, when in the first position and to allow movement of the locking element in the radial direction of the coupling body when in the second position. The dispensing device also comprises means for allowing axial movement of the release sleeve in relation to the coupling body in a direction towards the dispensing end of the device when the retaining collar is in the second position.

The poppet valve of the dispensing device may either be a poppet valve adapted to be opened or closed by movement of the poppet valve stem and poppet valve disc, or by axial movement of the seat of the poppet valve. Therefore, the poppet valve stem and poppet valve disc may be arranged to be axially movable in relation to the coupling body. Alternatively, the dispensing device comprises means for allowing axial movement of the inner flow sleeve in relation to the coupling body in a direction away from the dispensing end of the device when the retaining collar is in the second position, in which case the poppet valve stem is (directly or indirectly) attached to the coupling body. Said means for allowing axial movement of the inner flow sleeve in relation to the coupling body in a direction away from the dispensing end of the dispensing device comprises at least a connecting element or a link arm, said connecting element or link arm attached to the inner flow sleeve and extending through a radial slot of the coupling body. The alternative embodiment has the advantage that components arranged inside the main tubing of the dispensing device for causing the axial movement of the poppet valve stem can be avoided and thus components which may unduly influence the flow through the dispensing device can be minimised.

The means for allowing axial movement of the release sleeve in relation to the coupling body towards the dispensing end of the dispensing device when the retaining collar is in the second position preferably comprises a first spring in one end fastened in relation to the coupling body, such as by a spring pin or a spring ring, and in the other end adapted to cooperate with the release sleeve. Thereby, it is ensured that the release sleeve automatically will move axially towards the dispensing end unless withheld in its original position when the dispensing device is not coupled to a male coupling of a recipient.

The means for allowing axial movement of the inner flow sleeve in relation to the coupling body in a direction away from the dispensing end of the dispensing device may suitably further comprise at least an outer flow sleeve arranged radially outside of the coupling body and cooperating with the inner flow sleeve by the connecting element, such as a fastening element. The outer flow sleeve inter alia makes it easier to influence the axial movement of the inner flow sleeve in relation to the coupling body despite the fact that the inner flow sleeve is arranged radially inside of the coupling body.

As disclosed above, the coupling body may suitably comprise at least one radial slot in which the connecting element or link arm is arranged and allowed to move with the axial movement of the inner flow sleeve. Thereby, the inner flow sleeve can have an axial extension which is relatively small as the connection to the possible outer flow sleeve, or the connection via the link arm, does not need to be arranged at an axial end part of the coupling body. Furthermore, the size of the slot can be tailored such as to define the length of the axial movement of the inner flow sleeve.

The outer flow sleeve may be adapted to move axially in relation to the coupling body to thereby axially move the inner flow sleeve in relation to the coupling body. This achieves an effective control of the opening and closing of the poppet valve.

The means for allowing axial movement of the inner flow sleeve in relation to the coupling body may in addition to the outer flow sleeve also preferably comprises an actuator adapted to engage with the outer flow sleeve for allowing axial movement of the outer flow sleeve, and thus also the inner flow sleeve, away from the dispensing end of the dispensing device, and adapted to not engage the outer flow sleeve when the retaining collar is in its first position. This has the advantage that axial movement of the inner flow sleeve away from the dispensing end, such as for opening the poppet valve, is only temporarily possible and only when the coupling body has been coupled to a coupling body of a recipient in a secure manner. The actuator preferably engages the outer flow sleeve in an engagement notch or recess of the outer flow sleeve.

The actuator may in one end be connected to a flow control lever adapted to be operated by a user of the dispensing device and in the opposite end of the actuator adapted to engage the outer flow sleeve, the actuator being pivotably arranged. Thereby, the actuator can pivot between a position where it engages the outer flow sleeve and a position where it does not engage the outer flow sleeve in response to an operation of the flow control lever. Thereby, an operation of the flow control lever can effectuate an axial movement of the inner flow sleeve away from the dispensing end, which in turn opens the poppet valve.

The dispensing device may further comprise a release lever arm connected to the release sleeve and pivotable around a leverage point or leverage axis in response to an axial movement of the release sleeve. This release lever arm may force the release sleeve to move axially away from the dispensing end such that a coupling between the dispensing device and a coupling body of a recipient may be released.

The actuator may be adapted to cooperate with the release lever arm such that when the release lever arm is pivoted around said leverage point or leverage axis the actuator is moved from a position in which it does not engage with the outer flow sleeve to a position where it engages the outer flow sleeve. Thereby, it is possible to ensure that the axial movement of the outer flow sleeve, and thus the axial movement of the inner flow sleeve, away from the dispensing end are only possible in response to an operation of the flow control lever.

The cooperation of the actuator with the release lever arm may be achieved by a tap arrangement. More specifically, the actuator may comprise a slot into which a tap of the release lever arm protrudes, and the actuator is adapted to pivot between a position where it engages the outer flow sleeve and a position where it does not engage the outer flow sleeve in response to a movement of the release lever arm.

Also, it is preferred that the actuator is arranged such that it can engage the outer flow sleeve only when the release lever arm has been pivoted to a position where the release sleeve has been moved axially in relation to the coupling body towards the dispensing end of the dispensing device.

The dispensing device may further comprise a hooking element connected to the flow control lever and comprising an integrated spring to make it movable with the flow control lever, said hooking element adapted to cooperate with a hooking groove arranged in the release lever arm to thereby provide a mechanism ensuring that the release sleeve is unable to be axially moved towards the dispensing end of the dispensing device when the flow control lever is an operative position. This ensures that if the flow control lever should be activated by an operator when the dispensing device has not yet been firmly coupled to a male coupling of a recipient of the liquid to be dispensed, the release sleeve cannot move forward such that it would retain the locking elements in place and thereby the dispensing procedure cannot be activated as the inner flow sleeve cannot be axially moved away from the dispensing end.

According to an alternative embodiment of the dispensing device, the outer flow sleeve is adapted to rotate around the central axis to thereby axially move the inner flow sleeve in relation to the coupling body. This may for example be achieved by a slot in the outer flow sleeve being essentially S-shaped and wherein the connecting element between the inner flow sleeve and the outer flow sleeve is arranged to be moved inside said slot, but not movable in relation to the inner flow sleeve. In such an embodiment, the outer flow sleeve is preferably arranged such that it is prevented from any axial movement in relation to the coupling body. Such an embodiment is suitable especially in cases where the use of a flow control lever would be unsuitable or undesired for various reasons.

The dispensing device can in such a case suitably comprise turning means adapted to be operated by a user and connected or attached to the outer flow sleeve to enable a rotation of the outer flow sleeve around the central axis when the turning means are turned in a direction around said central axis. Thereby, it is easy for a user to manually operate the flow through the dispensing device even when there is no flow control lever.

The turning means may suitably be prevented from being able to be turned in a direction around the central axis when the retaining collar is in its first position by means of a locking groove arranged in an axial end of the release sleeve and cooperating with locking protrusion of the turning means. Thereby, it is ensured that accidental rotational movement of the outer flow sleeve, and thus axial movement of the inner flow sleeve away from the dispensing end, cannot be effectuated and thus, the poppet valve of the dispensing device can only be opened when a secured coupling of the dispensing device to a coupling body of a recipient has been achieved.

BRIEF DESCRIPTION OF DRAWINGS

FIGS. 5*a* to 5*g* each comprise a side view of the dispensing gun and a cross sectional view of the dispensing gun and illustrate different operational stages of the dispensing gun before and during a coupling procedure to a male coupling of a recipient.

FIGS. 6*a* and 6*b* are cross sectional views of a dispensing end of a dispensing gun and illustrate two steps at the start of a dispensing procedure according to an alternative embodiment of the poppet valve of a dispensing gun.

DETAILED DESCRIPTION

In the present disclosure, the terms "dispense" and "dispensing" shall be interpreted in their broadest sense and thus encompass all kind of physical transfer, delivery or administration of a medium, unless explicitly disclosed otherwise. A "dispensing device" shall therefore be interpreted as a device adapted for transferring, delivering or administrating a media from the device to another component or the environment, unless explicitly disclosed otherwise.

The term "poppet valve" shall in the present disclosure be considered in its broadest sense and thus encompasses all types of valves using a plug or the like shaped in correspondence with the shape of the hole and adapted to be seated against the valve seat. The term "poppet valve" in the present disclosure includes both a valve wherein the seat is stationary whereas the plug is movably arranged and a valve wherein the seat is movably arranged whereas the plug is stationary.

Furthermore, the term "sleeve" shall be considered to constitute a body which is hollow throughout its longitudinal extension and along its central axis. "Sleeve" shall not be considered to necessarily be an essentially rotational symmetrical body, but may also encompass other shapes such as having square shaped, oval or other shape as seen in the longitudinal cross section. It may also have different dimensions in different parts thereof along its longitudinal extension.

Moreover, the term "essentially rotational symmetrical around a central axis" shall be considered to mean rotational symmetrical around a central axis except for possible through openings, such as slots or the like extending through the wall thereof, or blind holes, grooves or the like. Thus, the essentially rotational symmetrical coupling body shall be interpreted as being made of a rotational symmetrical piece of material which may be provided with for example through openings, or blind holes/grooves in the wall thereof. Furthermore, "essentially rotational symmetrical" is intended to define a body which is essentially rotational symmetrical at least with regard to an inner and/or outer surface thereof but may encompass a body which for example has a portion which does not have a rotational symmetrical cross section. For example, the inlet end of the coupling body may if desired have another cross sectional shape of the inlet opening than a circular while the outer surface of the coupling body in said inlet end is rotational symmetrical.

The present invention will be described in more detail below with reference to the accompanying drawings. The drawings shall not be considered drawn to scale as some features may have been exaggerated in order to more clearly illustrate the invention.

Furthermore, the invention is not limited to the specific embodiments shown in the figures and discussed below but may be varied within the scope of the appended claims.

Figure 1:
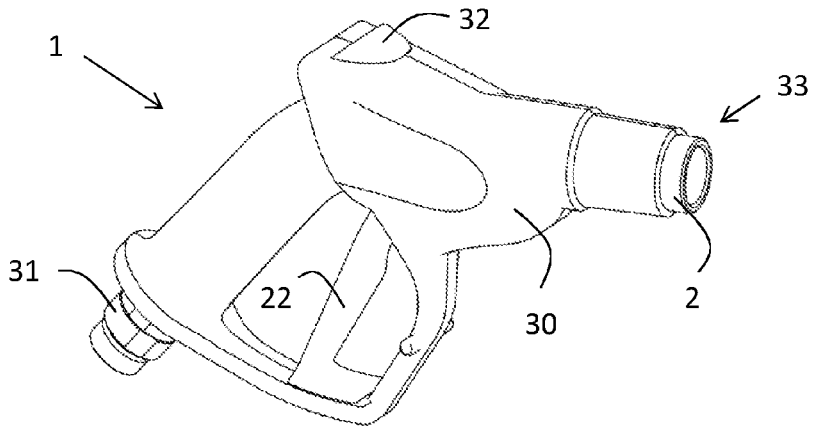
FIG. 1 is a perspective view of a dispensing gun.

FIG. 1 illustrates a dispensing gun 1 according to one exemplifying embodiment. The dispensing gun comprises means 31 for attachment to a liquid dispenser hose, such as a swivel inlet. The means for attachment to a liquid dispenser hose is not limiting for the invention and any previously known coupling may be used. The dispensing gun also comprises a housing 30. The housing serves as a cover for protecting the parts of the dispensing gun against mechanical damage and dirt or the like. The housing may for example be made of plastics, but any previously known material for a housing of dispensing gun may be used.

Inside the housing 30, the dispensing gun comprises a central body piping 34 (see FIG. 3*a*) constituting a flow path of the liquid to be dispensed from the inlet of the dispensing gun towards the outlet at the dispensing end of the dispensing gun. The dispensing gun furthermore comprises a flow control lever 22 intended to be manually operated by a user and preferably a coupling release button 32. Furthermore, at the dispensing end 33, the dispensing gun comprises a female coupling body 2 adapted to cooperate and be coupled to a male coupling, more specifically a male coupling body, of a recipient of the liquid to be dispensed during a dispensing procedure of the liquid. The male coupling part may for example be associated with a fuel tank of a vehicle.

Figure 2:
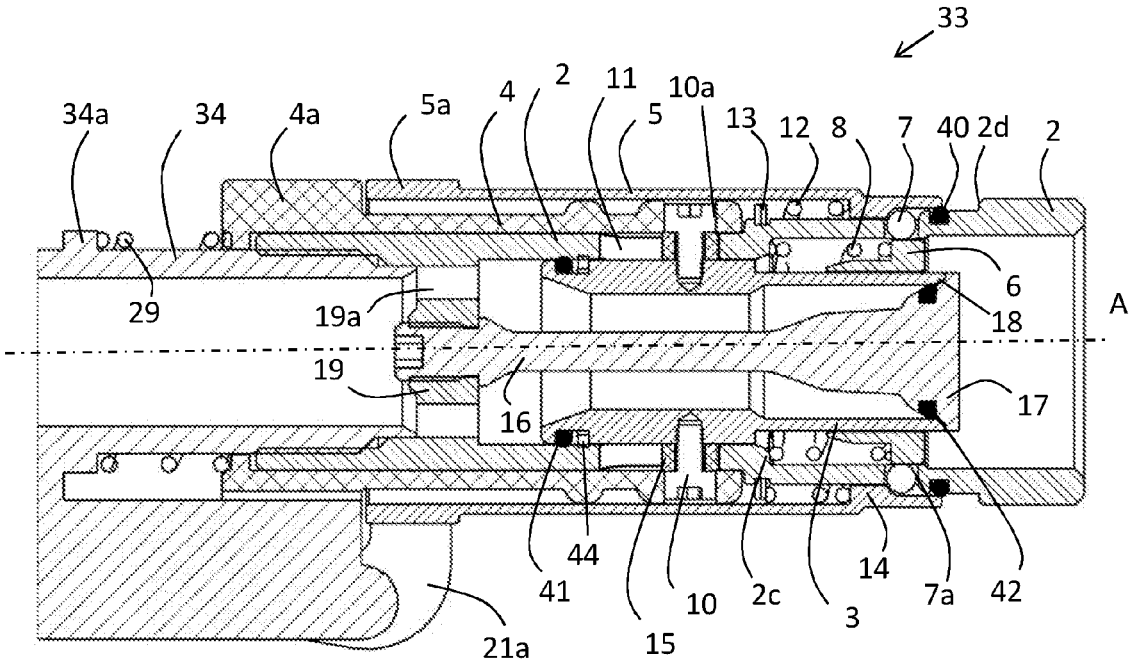
FIG. 2 is a cross sectional view of a dispensing end of a dispensing gun according to one embodiment of the invention.

FIG. 2 illustrates a cross sectional view of a dispensing end of a dispensing gun according to one exemplifying embodiment of the present invention. In the figure, the housing of the dispensing gun is not shown for sake of clarity. A coupling body 2 which forms the female coupling part of the dispensing gun is arranged at the dispensing end, i.e. the outlet end, of the dispensing gun. The coupling body 2 has a central axis A and is essentially rotational symmetrical around said axis. Furthermore, the coupling body 2 is essentially in the form of a hollow cylinder with varying inner and outer diameters in different parts thereof along the axial extension, and the inside of the coupling body at least partly forms a flow path for the fluid to be dispensed by the dispensing gun. The coupling body 2 may suitably have an inner diameter at the dispensing end which is greater than an inner diameter at an inlet end of the coupling body, i.e. the end which is arranged adjacent the main body piping of the dispensing gun. Moreover, the coupling body preferably has a greater outer diameter at the dispensing end than an outer diameter at the opposite end, i.e. the inlet end of the coupling body.

According to one embodiment, the coupling body 2 comprises an essentially radially arranged partition wall 19 comprising through-holes 19*a* for allowing the liquid to be dispensed to pass through said partition wall. The purpose of the partition wall is to provide attachment of a poppet valve stem 16 as will be described further below. The partition wall is preferably arranged at a distance from both of the axial ends of the coupling body as shown in FIG. 2. However, it is also plausible that the partition wall is arranged essentially at an inlet end of the coupling body.

According to another embodiment, the coupling body 2 may instead of a partition wall comprise an essentially radially arranged beam element or the like as long as it is able to attach the valve stem to said beam element.

At a distance from the outlet end of the coupling body 2, the coupling body comprises at least one radial through opening 7*a*. Such a radial through opening 7*a* preferably has a central axis essentially perpendicular to the central axis A of the coupling body. In the opening, a locking element in the form of a locking ball 7 is arranged. Even though the embodiment according to FIG. 2 illustrates the locking element as a locking ball, it is also plausible to use other types of locking elements such as a locking pin or a locking wedge. The locking element 7 is arranged such that it is radially movable in relation to the coupling body to and from a first position when the dispensing gun is not coupled to a male coupling part of a recipient of the liquid and a second position when the dispensing gun is firmly coupled to the male coupling part. In the first position, the locking element is preferably arranged essentially tangent to the inner surface of the coupling body, meaning that the radially innermost end surface of the locking element is essentially tangent to the radial inner surface of the coupling body, and the locking element protrudes radially outside of a radial outer surface of the coupling body. The locking element is retained in said first position by means of a retaining collar 6 as will be described further below. In the second position, the locking element engages a groove or recess of a male coupling part (not shown) to ensure that the coupling body of the dispensing gun is firmly held in place with the male coupling part. The locking element is preferably arranged, when in the second position, essentially tangent to a radial outer surface of the coupling body and protrudes radially inwardly of the radial inner surface of the coupling body.

According to a preferred embodiment, the dispensing gun comprises a plurality of locking element, each arranged in a corresponding radial through opening 7*a* of the coupling body 2. The locking elements 7 and their corresponding openings 7*a* in the coupling body may suitably be essentially equally spaced around the circumference. It is also possible to arrange locking elements at different axial distances from the dispensing end of the dispensing gun (not shown in the figures), for example in the form of two essentially parallel circumferential rings of locking balls, if desired.

The dispensing gun 1 further comprises a release sleeve 5 concentric with said central axis A and arranged radially outside of the coupling body 2. The length of the release sleeve, i.e. its axial extension, is preferably less than the length of the coupling body in the axial direction. The release sleeve comprises a radial inner surface which is adapted to be in contact with the locking element 7 arranged in the radial through opening 7*a* of the coupling body, thereby ensuring that the locking element 7 is retained in the through opening 7*a* of the coupling body. Furthermore, the release sleeve preferably comprises an inner flange 14 arranged at a distance from a first axial end of the release sleeve, said first axial end arranged towards the dispensing end of the dispensing gun. The inner flange 14 of the release sleeve 5 provides the release sleeve with a partially reduced inner diameter and is adapted to be slidably arranged on a radial outer surface of the coupling body.

The release sleeve 5 is adapted to be axially movable in relation to the coupling body 2 and is moved in a direction towards the dispensing end of the dispensing gun when the locking element 7 is moved radially from its first to its second position. Thereby, the inner flange 14 of the release sleeve is adapted to be in contact with the locking element 7 when the locking element has been moved to engage with a groove or recess of a male coupling body when the dispensing gun is coupled to the male coupling. Thus, the inner flange of the release sleeve can ensure that the locking element is not able to return to its first position unless the release sleeve is moved axially away from the dispensing end of the gun.

Furthermore, an O-ring 40 may suitably be arranged in a circumferential slot of the coupling body arranged in a portion of the coupling body which is adapted to be in contact with an axial end part of the release sleeve facing towards the dispensing end of the dispensing gun. Said O-ring serves the purpose of ensuring that dirt or moisture is not capable of entering the dispensing gun between the release sleeve and the coupling body, which could jeopardise the function thereof.

The dispensing gun furthermore comprises means for allowing axial movement of the release sleeve 5 in relation to coupling body in a direction towards the dispensing end. Preferably, said means comprises a spring 12 suitably arranged such that it cooperates with the inner flange 14 of the release sleeve and attached to the coupling body for example by a spring pin or spring ring 13. Thus, the release sleeve is preferably spring-loaded. Said spring 12 is preferably in an essentially unloaded state when the release sleeve 5 is in its second position, i.e. has been moved towards the dispensing end.

Preferably, the coupling body 2 comprises an essentially radially arranged surface 2*d* adapted to act as a stop for limiting the axial movement of the release sleeve towards the dispensing end of the dispensing gun. This surface acting as a stop may for example be provided in the form of an outwardly facing flange, or a partially increased outer diameter of the coupling body as shown in FIG. 2. According to an alternative embodiment, a separate stop attached to the coupling body may be provided for limiting the axial movement of the release sleeve towards the dispensing end of the dispensing gun. If so, the coupling body may have an essentially constant outer diameter along its axial extension if desired.

Inside the coupling body, an inner flow sleeve 3 is arranged concentric with said central axis A and the coupling body 2. The inner flow sleeve is completely surrounded by the coupling body. The inner flow sleeve may constitute a part of a flow sleeve assembly as will be described further below. The radial inner surface of the inner flow sleeve is preferably adapted to be subjected to the flow of the liquid during dispensing of liquid by the dispensing gun, and thus preferably constitutes a part of the flow path of the liquid. In order to avoid liquid to be dispensed from penetrating in between the inner flow sleeve and the coupling body, an O-ring 41 may suitably be arranged in a circumferential slot arranged in an radial outer surface of the inner flow sleeve close to an axial end part of the inner flow sleeve which is arranged closest to the central piping of the dispensing gun and thus constitutes an axial inlet end of the inner flow sleeve 3. To ensure that the inner flow sleeve is essentially concentric with the central axis of the coupling body at all times, a back-up ring 44 may suitably be arranged on a radial outer surface of the inner flow sleeve and adapted to be in contact with a radial inner surface of the coupling body.

The dispensing gun also comprises a poppet valve. The poppet valve stem 16 is attached to the coupling body 2, for example threadably attached to the coupling body, and has its axial extension essentially along the central axis A of the coupling body. The popped valve stem 16 may for example be attached to the coupling body 2 in the partition wall 19 or the beam element of the coupling body 2. Thus, the poppet valve stem 16 is not axially movable in relation to the coupling body when the dispensing gun has been assembled, and is not intended to move in relation to the coupling body during operation of the dispensing gun. The poppet valve disc 17 is adapted to be seated against an essentially axial end surface 18 of the inner flow sleeve 3 of the flow sleeve assembly, said end surface arranged at an axial end of the inner flow sleeve directed essentially towards the dispensing end of the dispensing gun. Thus, said essentially axial end surface 18 of the inner flow sleeve 3 serves as the seat for the poppet valve disc. The axial end surface 18 may suitably taper in the axial direction of the inner flow sleeve to provide an appropriate valve seat. The poppet valve is adapted to be opened and closed by axial movement of the inner flow sleeve 3. For this reason, the dispensing gun also comprises means for allowing axial movement of the inner flow sleeve in relation to the coupling body 2. The movement of the inner flow sleeve 3 is preferably step less thereby enabling the flow of the liquid to be dispensed to be regulated for example in response to manual operation of the flow control lever.

Inside the coupling body 2, essentially at the position of the locking elements 7, a retaining collar 6 is arranged. The retaining collar is preferably essentially rotational symmetrical and may suitably have an essentially cylindrical inner surface. However, the retaining collar need not be rotational symmetrical and comprise an essentially cylindrical inner surface in case of the dispensing gun only comprising one or a few locking elements. In such a case, the retaining collar may constitute an element which only forms a section of a rotational symmetrical element.

The retaining collar 6 is axially movable in relation to the coupling body 2 and is furthermore axially movable in relation to the inner flow sleeve 3. The retaining collar 6 is also guided on a radial outer surface of the inner flow sleeve 3 and thus preferably has an inner diameter essentially corresponding to the outer diameter of the inner flow sleeve in the region of the inner flow sleeve where the retaining collar is arranged. When the dispensing gun is in unconnected state, i.e. not connected to a male coupling, the retaining collar 6 retains the locking element(s) in their first position, preferably essentially tangent to the adjacent radial inner surface of the coupling body 2. For allowing the locking element 7 to be moved radially to the second position of the locking element, the retaining collar 6 is axially moved in a direction from the dispensing end of the dispensing gun, i.e. away from the outlet end of the dispensing gun. The retaining collar 6 is preferably spring loaded by means of a spring 8 providing a counter force during axial movement of the retaining collar away from the dispensing end. Said spring 8 is preferably in one end cooperating with an essentially radially arranged portion 2*c* of the radial inner surface of the coupling body as shown in FIG. 2. Moreover, the retaining collar may for example be retained by one or more spring pins 8*a* (see FIG. 4) inserted into the retaining collar and guided in slots 8*b* of the coupling body allowing the retaining collar to move axially in relation to the coupling body a limited distance. The movement of the retaining collar towards the dispensing end can alternatively or in addition to the one or more spring pins 8*a* be limited by a stop or a locking ring. Said stop may for example be in the form of a small inner radial flange of the coupling body 2 located axially closer to the dispensing end of the dispensing gun than the radial through opening 7*a* wherein the locking element 7 is arranged, and preferably close to said radial through opening 7*a*. The spring pin 8*a*, the stop and/or the locking ring are not limiting for the invention and other types of means for limiting the movement of the retaining collar towards the dispensing end further than the position where it retains the locking element are plausible.

As discussed above, the poppet valve is adapted to be opened and closed by means of an axial movement of the inner flow sleeve. The dispensing gun thus comprises first means for allowing axial movement of the inner flow sleeve in relation to the coupling body in a direction from the dispensing end of the dispensing gun. The dispensing gun preferably also comprises second means for allowing axial movement of the inner flow sleeve in relation to the coupling body in a direction towards the dispensing end of the dispensing gun.

Said first means for allowing axial movement of the inner flow sleeve may suitably comprise an outer flow sleeve 4 as shown for example in the embodiment illustrated in FIG. 2. The denomination "outer flow sleeve" in the present disclosure shall not be considered to mean a sleeve which is necessarily in contact with the flow of liquid inside the dispensing gun, but merely a sleeve which in some way is adapted to influence the flow of liquid inside the dispensing gun.

As shown in FIG. 2, the outer flow sleeve 4 is arranged radially outside of the coupling body and is connected to the inner flow sleeve 3 by a connecting element, for example a fastening element. In FIG. 2, the fastening element is illustrated as a socket head screw 10. The socket head screw is attached to the inner flow sleeve 3 and the head of the screw is connected to the outer flow sleeve via a slot 10*a* arranged in the outer flow sleeve 4. A spacer 15 may optionally be fixed between the inner flow sleeve and the screw head. The spacer guides the connecting element in radial slots 11 of the coupling body, said slots 11 having an extension in the axial direction of the coupling body for allowing the inner flow sleeve to axially move back and forth a limited distance. Thus, in accordance with the embodiment shown in FIG. 2, the outer flow sleeve 4 and the inner flow sleeve 3 are preferably adapted to be fixedly connected to each other such that they are axially movable with each other in relation to the coupling body 2. The outer flow sleeve and the inner flow sleeve thus forms a flow sleeve assembly together with the connecting element.

Even though FIG. 2 illustrates an embodiment wherein the connecting element constitutes a fastening element and the inner flow sleeve 3 and the outer flow sleeve 4 are two separate components, the inner flow sleeve 3 and the outer flow sleeve 4 do not necessarily need to be two separate components. The only reason for having two separate flow sleeves in this embodiment and the separate fastening element is to facilitate assembly of the dispensing gun. It is however also possible to utilise a flow sleeve assembly comprising the inner and outer flow sleeve, wherein the inner and outer flow sleeves and the connecting element are integrated into a monolithic structure. This can for example be achieved by manufacturing the inner and outer flow sleeves of a suitable material wherein one of the flow sleeves could comprise the connecting element and, after assembly of the inner and outer flow sleeves with the coupling body such that the connecting element extends through a slot of the coupling body, allowing the connecting element to be fused, welded or brazed to the other flow sleeve thereby achieving a permanent attachment between the inner and outer flow sleeve via the connecting element. Such an embodiment should also be considered to be a flow sleeve assembly in the present disclosure.

The dispensing gun furthermore preferably comprises second means for axial movement of the inner flow sleeve towards the dispensing end to allow the poppet valve to be closed. Such second means for axial movement of the inner flow sleeve may suitably comprise the above mentioned outer flow sleeve and a spring 29 (see also FIG. 4) which is in its rested state when the outer flow sleeve is in its axial foremost position, i.e. its closest position to the dispensing end of the dispensing gun. When the outer flow sleeve has been axially moved away from the dispensing end, the spring is compressed such that it cause the outer flow sleeve to return to its axial foremost position when the dispensing procedure is terminated. The spring 29 may suitably be provided such that the outer flow sleeve 4 is spring loaded against a radially extending flange 34*a* of the central body piping 34. However, other arrangements are also plausible, such as attachment of the spring by a spring ring, spring pins or the like.

As mentioned above, the outer flow sleeve 4 mainly serves the purpose of providing means for allowing axial movement of the inner flow sleeve in relation to the coupling body. However, the dispensing gun need not necessarily comprise an outer flow sleeve to be able to allow axial movement of the inner flow sleeve in a direction away from the dispensing end of the dispensing gun. For example, the outer flow sleeve can be substituted by a link arm extending through an essentially radial slot of the coupling body, such link arm attached to the inner flow sleeve. Alternatively, the link arm may be attached to the connecting element extending through the radial slot in the coupling body such as to allow influencing the movement of the connecting element and thereby the inner flow sleeve.

When present, the outer flow sleeve 4 is at least partly arranged radially inside of the release sleeve 5 in order to be able to cooperate with the inner flow sleeve 3. However, the outer flow sleeve is preferably arranged such that a first axial end portion 4*a* of the outer flow sleeve, said first axial end portion constituting the axial end portion furthest away from the dispensing end of the dispensing gun, preferably extends axially further away from the dispensing end of the dispensing gun than a first axial end portion 5*a* of the release sleeve, said first axial end portion of the release sleeve constituting the axial end portion furthest away from the dispensing end of the dispensing gun. The reason for this is to facilitate engagement of an actuator to the outer flow sleeve as will be described in more detail below. Moreover, said first axial end portion of the outer flow sleeve preferably has an increased outer diameter, as shown in FIG. 2, for the same reason.

Figure 3A:
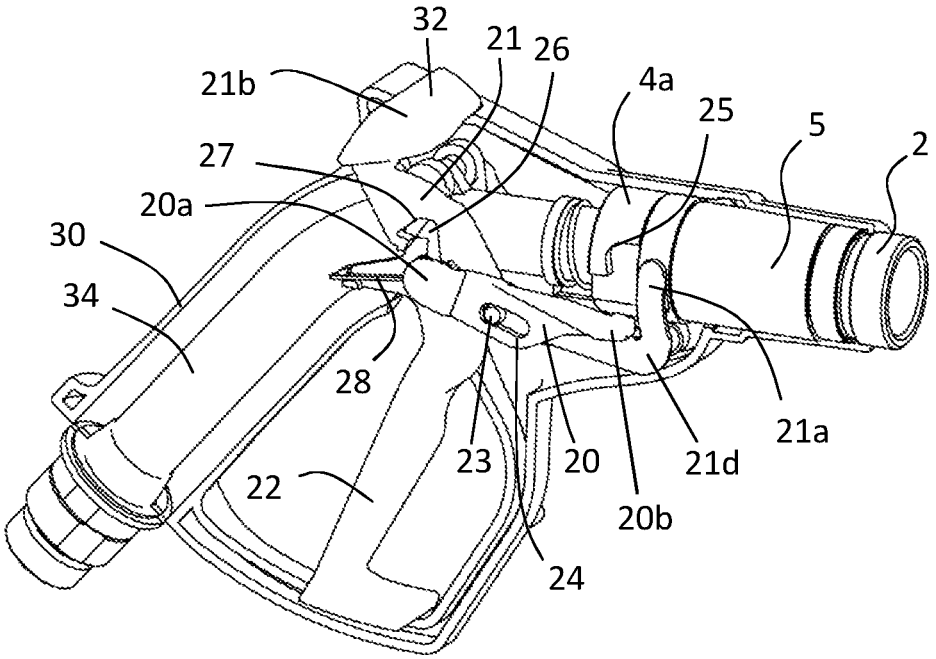
FIGS. 3*a* and 3*b* are perspective views of a dispensing gun according to an embodiment of the invention before the dispensing gun has been coupled to a male coupling of a recipient and when coupled to a male coupling body of such a male coupling.
Figure 3B:
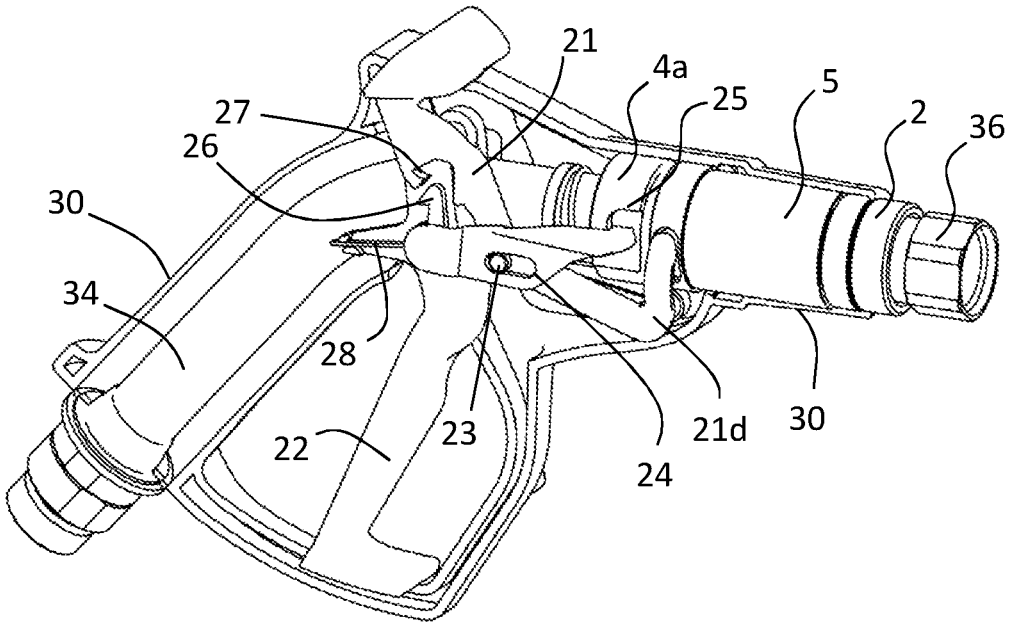

As shown for example in FIGS. 3*a* and 3*b*, the means for allowing axial movement of the inner flow sleeve 3 in relation to the coupling body 2 preferably also comprises an actuator 20 adapted to engage with the outer flow sleeve 4 when the outer flow sleeve is to be moved axially. The actuator 20 is preferably in one end 20*a*, or close to one end thereof, connected to the flow control lever 22 which is to be operated by a user, thereby enabling operation of the actuator in response to operation of the flow control lever 22. Furthermore, the actuator is movable and pivotable around an axle provided by one or two taps 23 which suitably are attached to the release lever arm 21 or being an integrated part thereof (see also FIG. 4). The tap 23 suitably protrudes from the release lever arm along an axis which is essentially perpendicular to an axis parallel with the central axis of the coupling body 2. Moreover, the tap 23 is engaged in an essentially central slot 24 of the actuator enabling the actuator to pivot by movement of the tap 23 in the slot 24 (resulting from a movement of the release lever arm 21). The actuator is pivotably arranged such that the end 20*b* opposite the end connected to the flow control lever may temporarily engage the outer flow sleeve 4 in order to thereby enable axial movement of the inner flow sleeve 3 in response to the operation of the flow control lever by a user. In order to facilitate the engagement of the actuator to the outer flow sleeve, the outer flow sleeve preferably comprises an engagement notch or recess 25 suitably arranged in the radial outer surface of the first axial end portion 4*a* thereof. In FIG. 3*a*, the actuator does not engage the outer flow sleeve whereas in FIG. 3*b*, it does engage the outer flow sleeve.

In an embodiment wherein the dispensing gun does not comprise an outer flow sleeve (not shown in the figures), the actuator 20 may be connected to the inner flow sleeve 3 by a link arm and/or connecting element extending through a radial slot 11 in the coupling body 2 (as discussed above)

such that the actuator may effectuate an axial movement of the inner flow sleeve 3 in relation to the coupling body 2 in response to an operation of the flow control lever 22 by a user.

Figure 4:
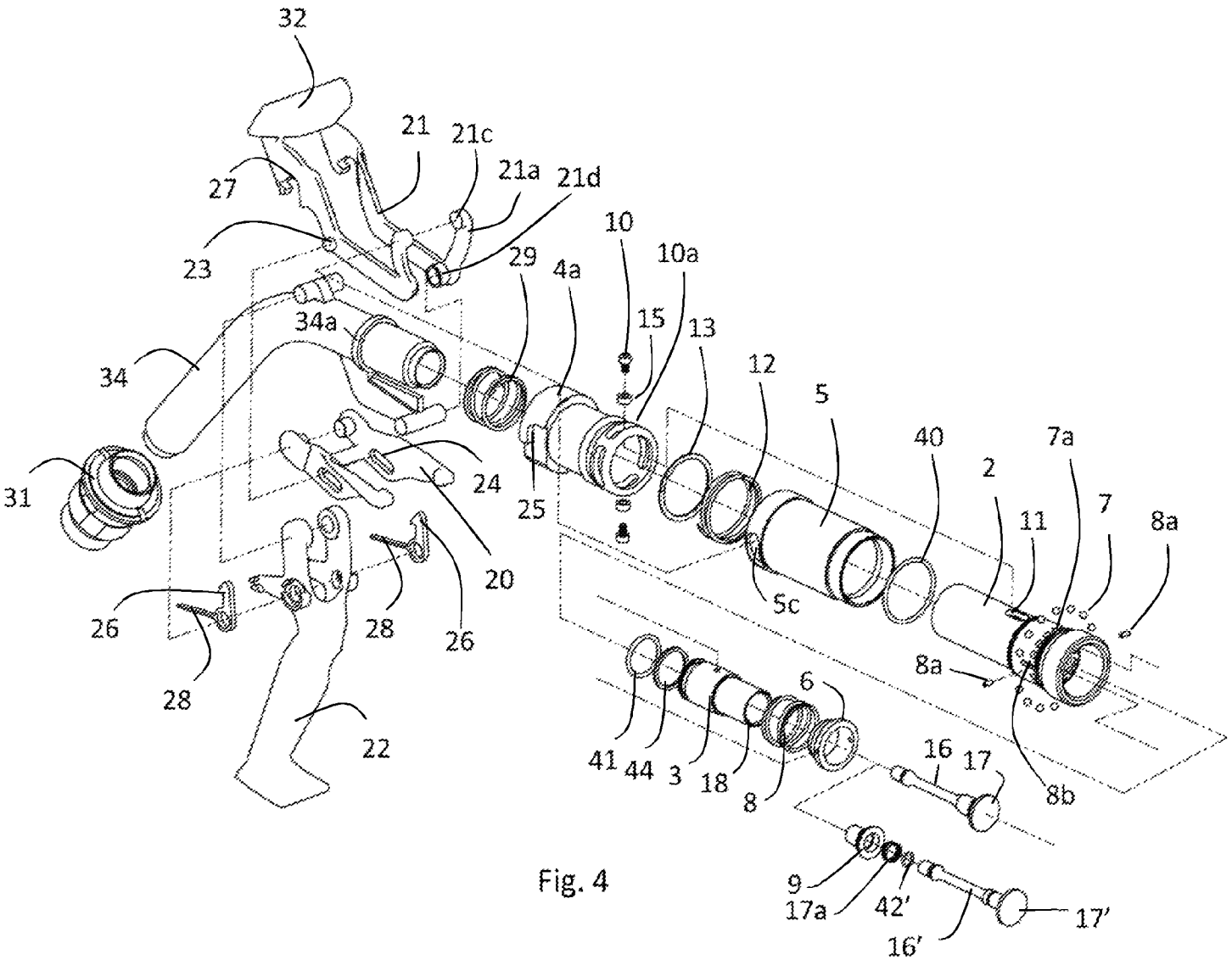
FIG. 4 is an exploded perspective view of the dispensing gun as shown in FIGS. 2, 3*a* and 3*b* and including two different embodiments of a poppet valve.

The dispensing gun preferably also comprises a release lever arm 21 which is connected to the release sleeve 5 in one end 21*a* and arranged pivotable around a leverage point 21*d* or leverage axis in response to an axial movement of the release sleeve. The release lever arm may be attached to the release sleeve by a tap arrangement (21*c*, 5*c* as shown in FIG. 4) or any other suitable attachment. The end 21*a* of the release lever arm attached to the release sleeve is however preferably arranged radially outside of the release sleeve 5 in relation to the coupling body in order not to interfere with the flow sleeves and coupling body of the dispensing gun. In the end 21*b* of the release lever arm opposite the end attached to the release sleeve, the release lever arm is preferably attached to a release button 32. The release button may also be an integrated part of the release lever arm as shown for example in FIGS. 3*a* and 4. When the release lever arm 21 pivots around its leverage point 21*d* or leverage axis in response to the axial movement of the release sleeve 5, it also influences the release button 32 which is allowed to pop-up.

According to one embodiment as shown in FIGS. 3*a* and 3*b*, the dispensing gun may also comprise a blocking mechanism in order to prevent a male coupling from being connected to the dispensing gun in case the flow control lever is in an "OPEN" position, i.e. in an operative position which would allow a flow of liquid in case the dispensing gun is firmly coupled to a male coupling of a recipient. The blocking mechanism provides an additional measure for avoiding an accidental dispense of liquid before a liquid-tight connection has been firmly secured. The blocking mechanism comprises a hooking element 26 with an integrated spring 28 which makes it follow the movement of the flow control lever 22. The hooking element 26 is adapted to engage a hooking groove 27 arranged in the release lever arm 21 when the blocking mechanism is active. Such an engagement of the hooking element in the hooking groove prevents the release sleeve from moving axially forward towards the dispensing end of the dispensing gun even if the retaining collar has been moved in a direction away from the dispensing end. Thus, the engagement of the hooking element ensures that the locking element(s) cannot be securely held in the position where they lock the male coupling body. That is, the locking element(s) are able to move radially in a direction away from the central axis of the coupling body and the male coupling body is thus released from the dispensing gun.

FIG. 3*a* shows the dispensing gun with the blocking mechanism in a state wherein the dispensing gun has not yet been coupled to a male coupling of a recipient and the hooking element 26 will engage the hooking groove in case the flow control lever is activated for example by a user. In contrast, FIG. 3*b* shows the state wherein the dispensing gun has been firmly connected to a male coupling body 36 of a recipient and the hooking element 26 will not engage the hooking groove 27 in case the flow control lever is activated.

The hooking element 26 is arranged such that when the flow control lever 22 is held in a "CLOSED" position, i.e. in a position wherein a flow of liquid is not enabled, it will not be positioned for a possible engagement with the hooking groove in the release lever arm as shown in FIG. 3*b*. The hooking element is positioned from a possible engagement with the hooking groove by the rotation of the release lever arm around the release lever arm leverage axis (or leverage point), which in turn is achieved by the release sleeve moving forward such that it secures the locking elements in their locking position to the male coupling body of the recipient. Thereby, a secure and liquid-tight coupling of the dispensing gun to a male coupling is enabled before a dispensing procedure can be started. In case the flow control lever would be actuated before the dispensing gun has been firmly coupled to the male coupling, the release sleeve is unable to move axially towards the dispensing end of the dispensing gun as the hooking element cannot be disengaged from the hooking groove in the release lever arm, which in turn therefore cannot rotate around its leverage axis or leverage point.

FIG. 4 illustrates an exploded view of the dispensing gun according to the embodiment shown in FIGS. 2, 3*a* and 3*b*. As can be seen from the figure, the release button 32 is preferably integrated with a release lever arm 21 to one solid unit. Taps 21*c* at the release lever arm (positioned over its leverage point 21*d* or leverage axis) protruding radially inwardly towards the central axis A are adapted to be arranged in a slot 5*c* on each side of the release sleeve 5 for providing the attachment of the release lever arm to the release sleeve.

FIG. 4 illustrates a poppet valve as shown in FIG. 2 wherein the poppet valve disc 17 is formed in one single unit with the poppet valve stem 16. In said embodiment, the poppet valve disc, which may have an axially tapering form in at least a part thereof, forms the plug of the poppet valve. Moreover, FIG. 4 also illustrates an alternative embodiment of a poppet valve. Like in the first embodiment of the poppet valve, the poppet valve stem 16' is attached to the poppet valve disc 17' and may suitably be one single unit or alternatively, the disc may be permanently attached to the poppet valve stem. However, in contrast to the first embodiment of the poppet valve, the alternative embodiment comprises a separate plug 9 which is adapted to be seated against the valve seat formed by the inner flow sleeve. The plug 9 is spring loaded by means of a spring 17*a* arranged between the poppet valve disc 17' and the plug 9. An O-ring 42' is preferably arranged between the plug 9 and the poppet valve stem. Another O-ring 42" may suitably be arranged on a radial outer surface of the plug 9 (see FIGS. 6*a* and 6*b*)

In the following, the different steps of the coupling procedure of the dispensing gun 1 to a male coupling body 36 of a recipient of the liquid to be dispensed will be described with reference to FIGS. 5*a* to 5*g* which show different operational stages of the dispensing gun. Each of the figures show a side view of the dispensing gun and a male coupling 46 comprising a male coupling body 36 as well as an enlarged cross sectional view of the dispensing end of the dispensing gun and a male coupling. It should be noted that the male coupling shown in the figures has no effect on the scope of the claims and may be constructed in other manners than shown. In the coupling procedure described below, the specific embodiment of the dispensing gun as described above with reference to FIGS. 2 to 4 is used. However, the coupling procedure is not limited to the specific embodiment of the dispensing gun disclosed and a corresponding coupling procedure will be readily apparent to the skilled person in the art for other embodiments of the present invention.

Figure 5A:
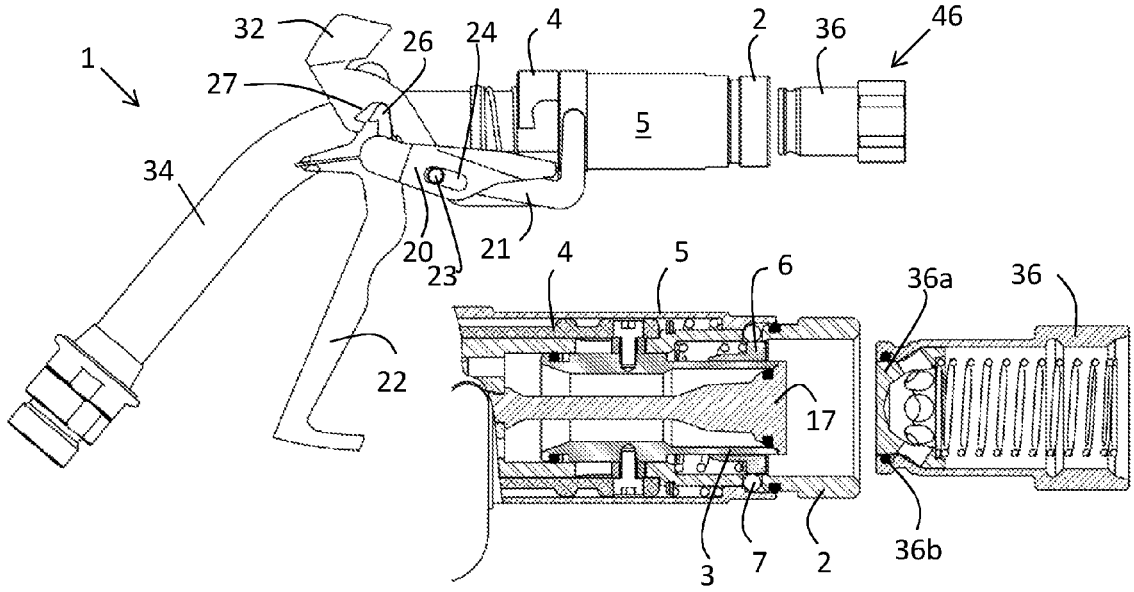

FIG. 5*a* shows the internal components of the dispensing gun 1 and a male coupling body 36 before the dispensing gun 1 has been coupled to the male coupling 46 of a recipient and wherein the flow control lever is in a "CLOSED" position, i.e. has not been activated by a user.

Figure 5B:
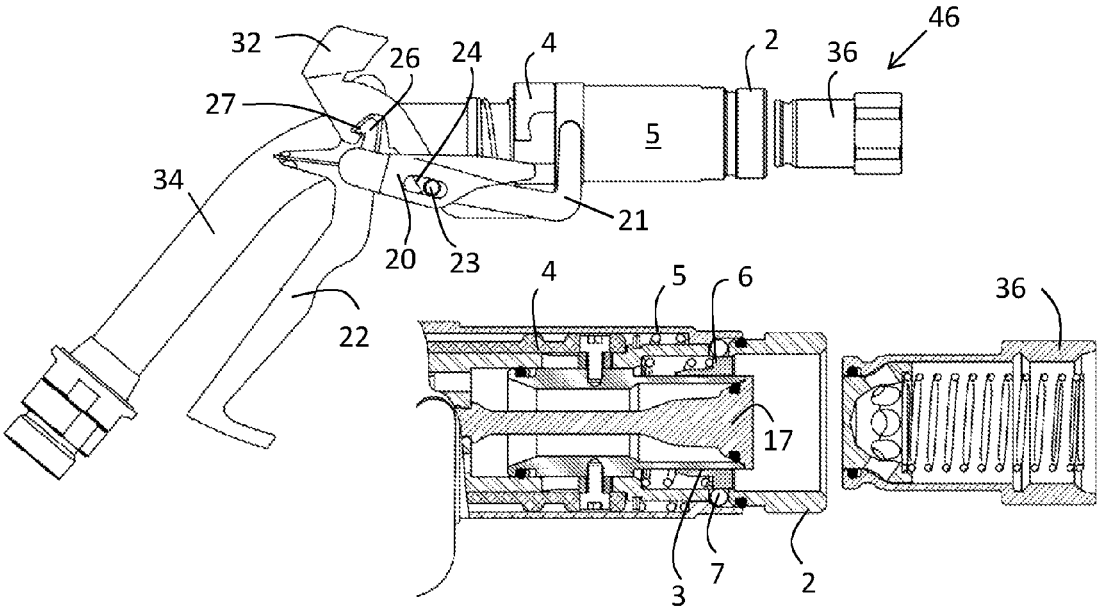

As can be seen from FIG. 5*a*, the actuator 20 does not engage the outer flow sleeve 4 and can therefore not axially move the outer flow sleeve. Thus, a flow through the poppet valve is not enabled since the inner flow sleeve 3 is not moved axially in relation to the coupling body. Furthermore, should the flow control lever be actuated at this point i.e. before a liquid tight coupling to a male coupling is established, the hooking element 26 would engage the hooking groove 27 as shown in FIG. 5*b*, thus preventing the release sleeve 5 from axially moving towards the dispensing end of the dispensing gun. Thus, the hooking element and the hooking groove provide an additional measure for securing that the dispensing operation cannot start.

Figure 5C:
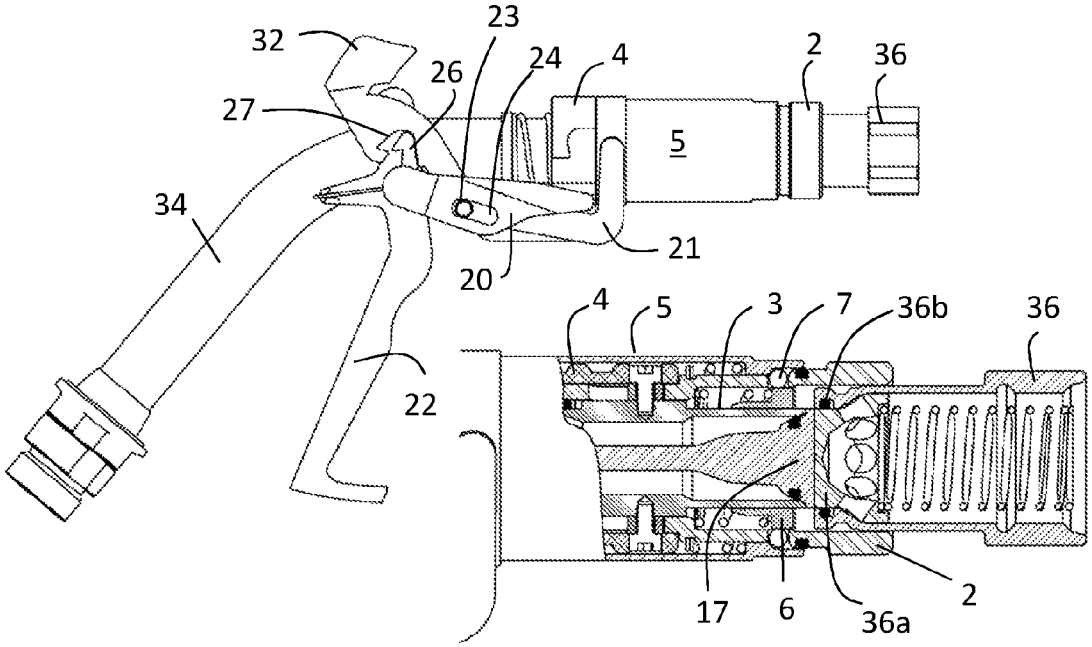

In the first step of the coupling procedure, the female coupling body 2 of the dispensing gun is brought to the male coupling 46 (for example associated with a tank of a vehicle) such that the male coupling body 36 enters the female coupling body 2 and such that the poppet valve disc 17 of the dispensing gun and the male coupling poppet valve disc 36*a* meet "face-to-face", i.e. abuts each other, as shown in FIG. 5*c*.

Figure 5D:
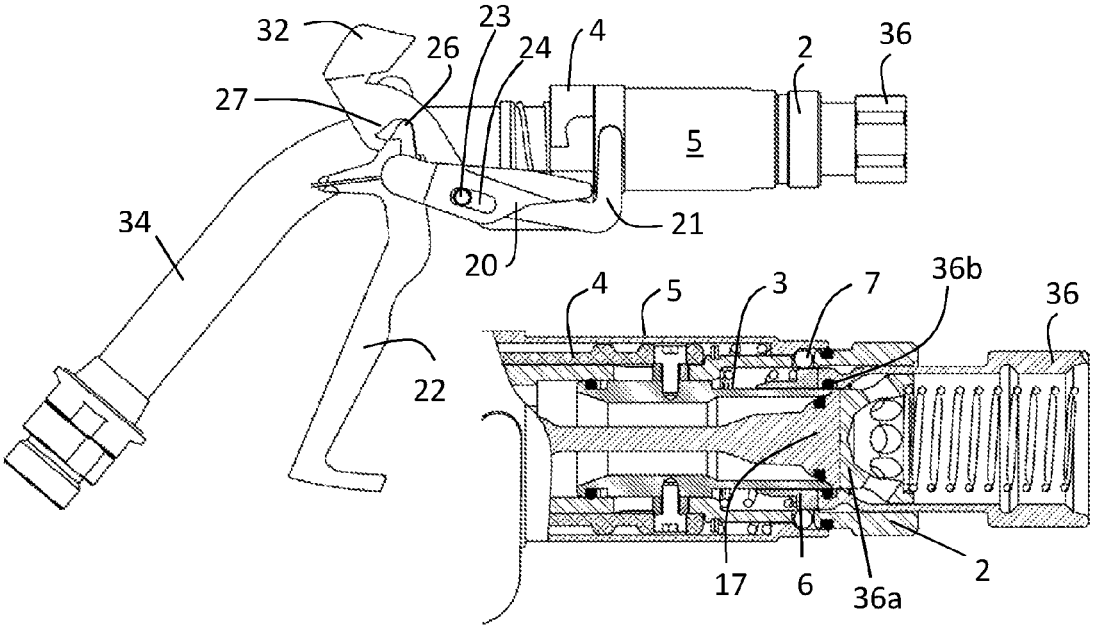
Figure 5E:
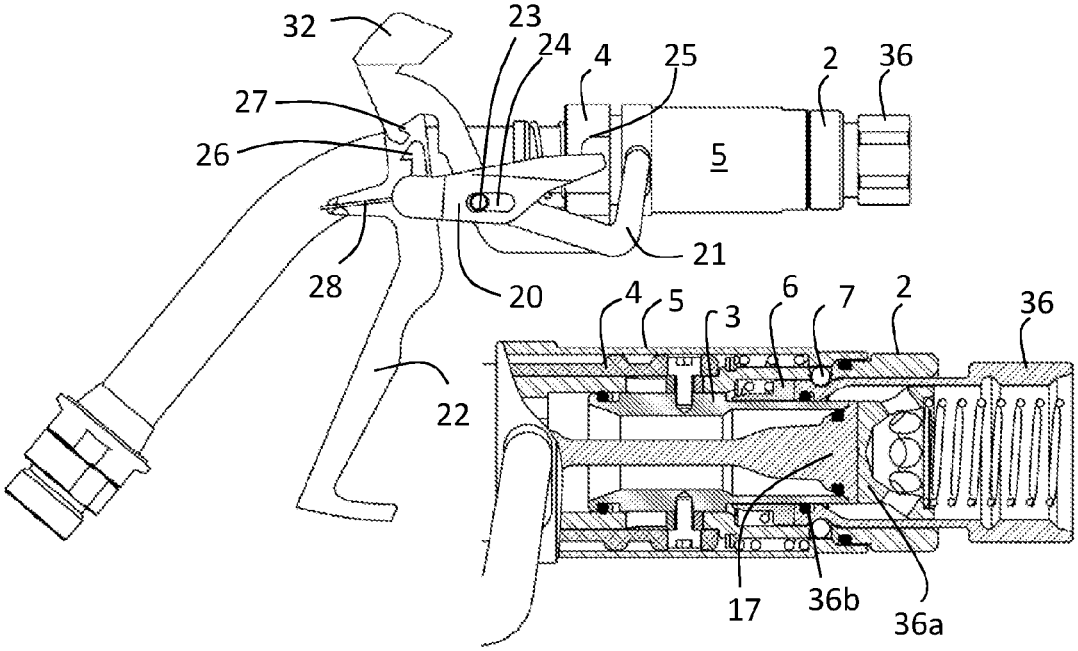

As shown in FIG. 5*d*, the female coupling body 2 is then moved further onto the male coupling body 36 such that the poppet valve disc 36*a* of the male coupling body is forced into the male coupling body thus opening the poppet valve of the male coupling. Moreover, an O-ring 36*b* of the male coupling body is pushed over the tip of the inner flow sleeve 3 and the retaining collar 6 and the male coupling body meet face-to-face. A liquid tight connection (however not yet secured) has thus been achieved. When the female coupling body 2 is moved even further onto the male coupling, the male coupling body forces the spring loaded retaining collar 6 further into the female coupling body, i.e. in a direction away from the dispensing end of the dispensing gun. When the male coupling body is in its innermost position, as shown in FIG. 5*e*, the locking balls 7 falls into a groove of the male coupling body, making it possible for the spring loaded release sleeve 5 to move axially forward and thereby retain the locking balls 7 in locking position. Thus, a liquid tight connection has now been firmly secured. However, the poppet valve of the dispensing gun is still closed and the flow of liquid through the poppet valve of the dispensing gun has thus not yet been effectuated.

When the release sleeve moves axially towards the dispensing end of dispensing gun it also moves the release lever arm 21 forward by its tap attachment in the release sleeve slots 5*c* causing the release lever arm 21 to pivot around its leverage point or leverage axis. The release button 32 integrated to the release lever arm consequently pops up. Moreover, a tap 23 of the release lever arm move actuator 20 to a position where one end of the actuator engages with outer flow sleeve by engagement of an outer flow sleeve hook or the like, as also shown in FIG. 5*e*. Furthermore, the hooking element 26 is released from a possible engagement with the hooking groove 27 of the release lever arm and therefore does no longer prevent an axial movement of the release sleeve towards the dispensing end.

Figure 5F:
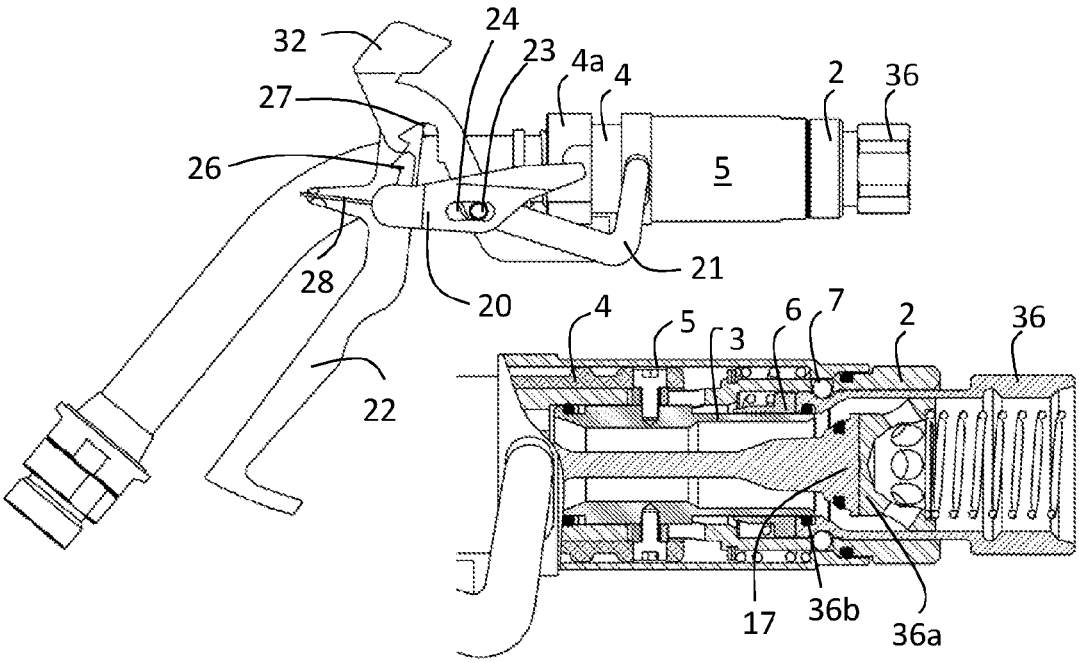

In order to start the dispensing procedure, the flow control lever 22 is operated by a user who presses the lever in a direction towards the central body piping at a gripping portion of the dispensing gun in the same manner as conducted for example when operating conventional dispensing nozzles used at refuelling stations. In accordance with the present invention, the actuation of the flow control lever causes the actuator to move the outer flow sleeve axially in a direction away from the dispensing end of the dispensing gun, as shown in FIG. 5*f*. This is turn moves the inner flow sleeve in the same direction due to the connection between the inner and outer flow sleeves. The axial movement of the inner flow sleeve opens the poppet valve, and liquid is thus dispensed to the male coupling.

If the release button 32 is pressed down by the user, the actuator 20 is automatically disengaged from the outer flow sleeve 4 as shown in FIG. 5*g*. The inner flow sleeve is thereby also automatically returned to its original position and the poppet valve thus closed. Furthermore, the release sleeve is able to move axially away from the dispensing end such that the locking balls 7 can be moved radially out of the groove of the male coupling body and the dispensing gun can therefore be removed from the male coupling of the recipient.

Figure 7A:
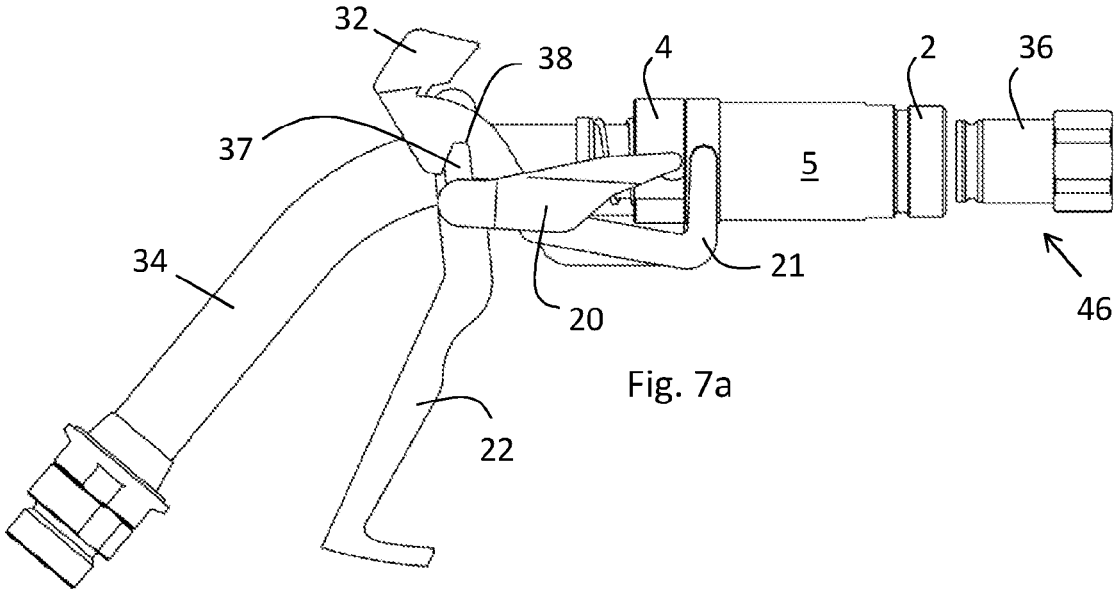
FIGS. 7*a* to 7*c* are side views of an alternative embodiment of a dispensing gun according the invention and illustrate different steps of a coupling procedure of the dispensing gun to a male coupling.
Figure 7B:
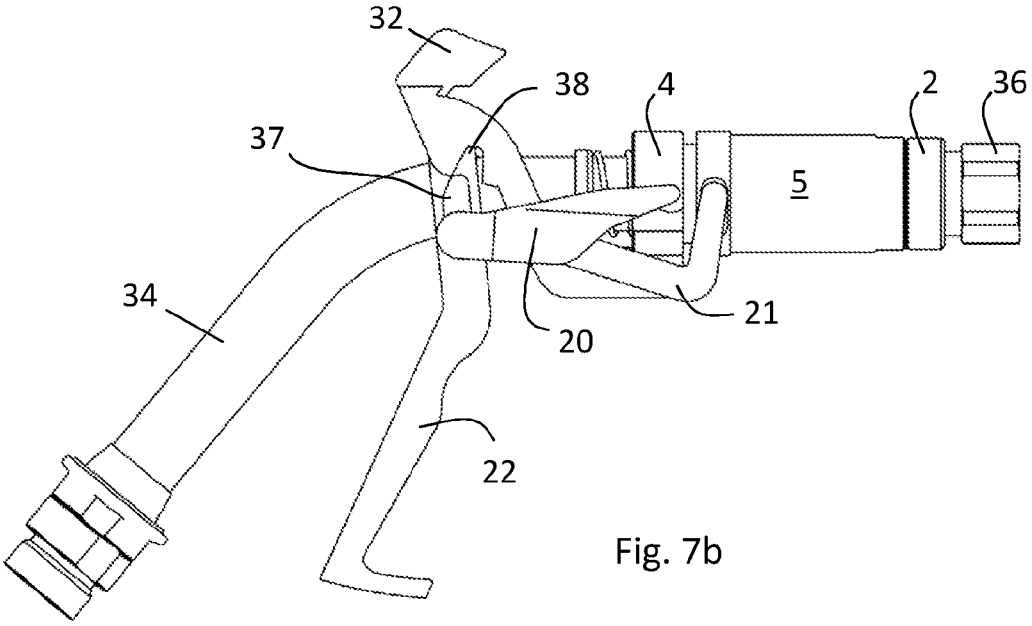
Figure 7C:
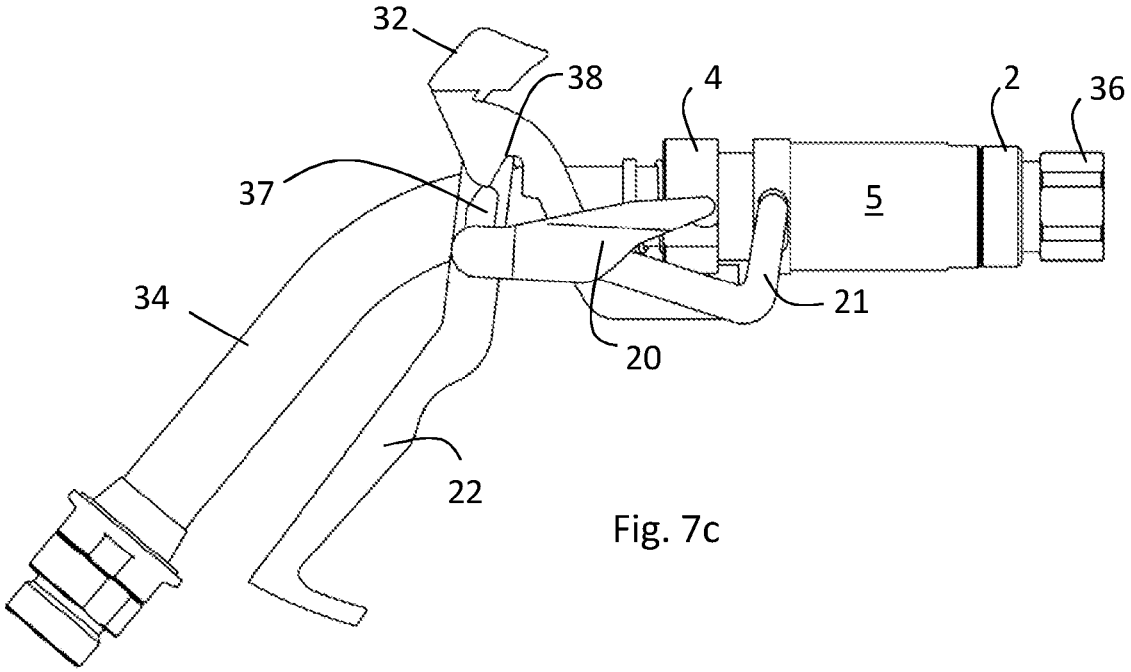

FIGS. 6*a* and 6*b* illustrates the two steps at the start of the dispensing procedure, i.e. when a firm coupling with a male coupling body 36 has been achieved, according to the alternative embodiment of the poppet valve of the dispensing gun as previously also shown in FIG. 4. In the FIGS. 6*a* and 6*b*, the inner flow sleeve 3 has been moved axially in a direction away from the dispensing end of the dispensing gun and the shown two steps thus correspond to the step shown in FIG. 5*f* for the first embodiment of the poppet valve. As shown in FIG. 6*a* the poppet valve guide disc 17' meets and abuts the poppet valve disc 36*a* of the male coupling body while the poppet valve plug 9 remains seated against the inner flow sleeve 3. Thus, when the inner flow sleeve 3 is moved in a direction away from the dispensing end, the plug 3 has also moved axially in relation to the coupling body 2 in a direction away from the dispensing end. When liquid starts to flow into the poppet valve of the dispensing gun it forces the poppet valve plug 9 towards the poppet valve guide disc 17' against the spring load provided by spring 17*a*, as shown in FIG. 6*b*. This alternative embodiment of the poppet valve has the advantage of stopping the flow directly when the pump which pumps the liquid through the dispensing gun is stopped and the pressure of the liquid thus decreases. Furthermore, it ensures that no extra liquid is supplied through the dispensing gun after a dispensing procedure is terminated. This is due to the plug 9 being adapted to automatically move to a position where it is seated against the inner flow sleeve by means of the force provided by the spring 17*a* when the pressure of the liquid decreases FIGS. 7*a* to 7*c* illustrate an alternative embodiment of the dispensing gun. It essentially corresponds to the embodiment disclosed with reference to FIGS. 2 to 4, except that it does not comprise the above disclosed blocking mechanism comprising the hooking element and hooking groove. Instead, the embodiment shown in FIGS. 7*a* to 7*c* comprises means for securing that the flow control lever cannot be actuated or otherwise moved unless the dispensing gun has been firmly coupled to a male coupling of a recipient. This is achieved by the flow control lever comprising a protruding member 37 adapted to be secured in a securing recess 38 in the release lever arm thereby ensuring that the flow control lever 22 cannot be moved when the dispensing gun has not been firmly coupled to a male coupling body 36 of a male coupling 46, as shown in FIG. 7*a*. When a firm coupling has been achieved by the release sleeve having been axially moved forward and thus ensures that the locking elements engage the male coupling body, the protruding member of the flow control lever is disengaged from the securing recess by the pivot movement of the release lever arm around its leverage point or leverage axis, as shown in FIG. 7*b*. Thus, the flow control lever can be actuated by a user and a dispensing procedure start, as shown in FIG. 7*c*.

It should be noted that even though the slot 24 in the actuator 20 is not visible in FIGS. 7*a* to 7*c*, it is still present. It will be readily apparent to the person skilled in the art that the slot 24 may be in the form of a through opening as shown for example in FIG. 4 or in the form of a blind hole in the actuator 20, which is the case in FIGS. 7*a* to 7*c*, in any of the embodiments shown without departing from the scope of the present invention.

Figure 8A:
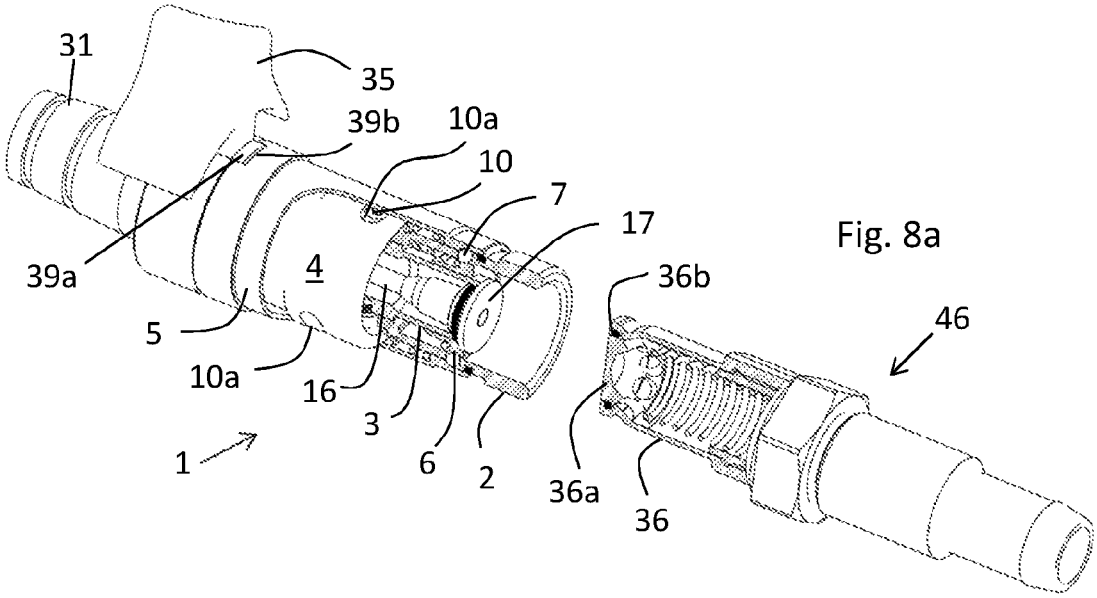
FIGS. 8*a* to 8*c* are perspective views of a dispensing end of a dispensing gun according to another embodiment and illustrate different steps of a coupling procedure of a dispensing gun to a male coupling.
Figure 8B:
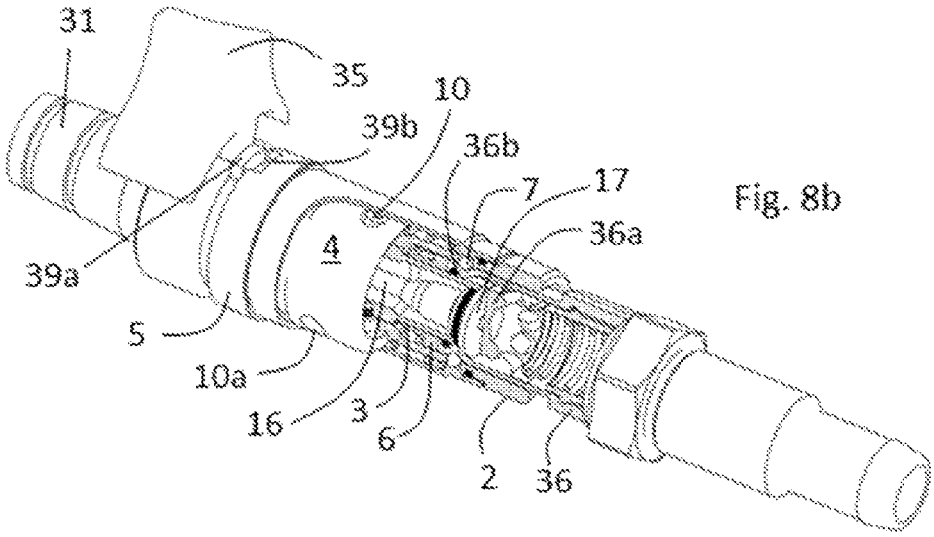
Figure 8C:
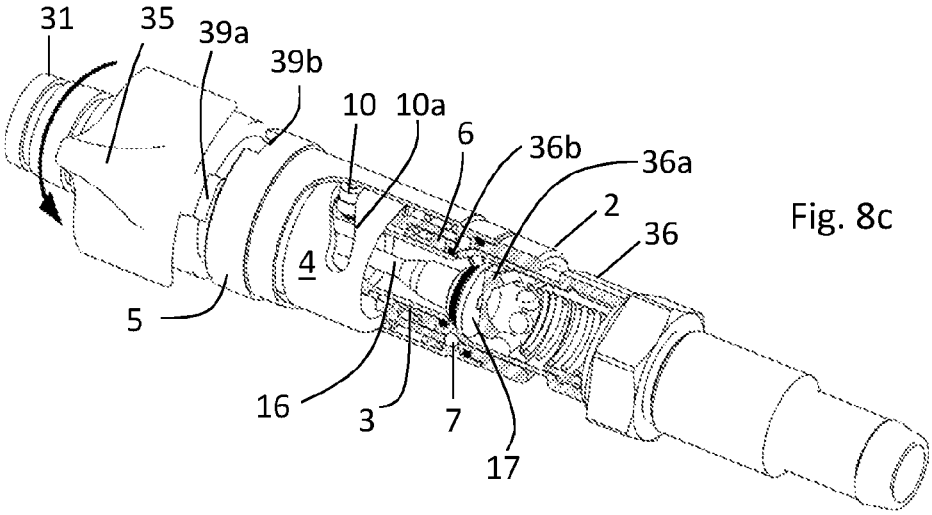

FIGS. 8*a* to 8*c* illustrate an alternative embodiment of a dispensing gun according to the invention and the coupling procedure to a male coupling 46 of a recipient. The dispensing gun 1 comprises a coupling body 2, an inner flow sleeve 3, a release sleeve 5, a locking element 7, a retaining collar 6 and a poppet valve similar to the disclosure as shown in FIG. 2. However, in contrast to the embodiment shown in FIGS. 2 to 4, the dispensing gun does not comprise a flow control lever. Instead the dispensing gun comprises a turning means 35, such as a knob or the like, which can be operated by a user of the dispensing gun for effecting the flow of liquid to be dispensed. The turning means is adapted to be turned essentially around the central axis of the coupling body and thereby influencing the axial movement of the inner flow sleeve to open the poppet valve.

The dispensing gun as shown in FIGS. 8*a* to 8*c* furthermore comprises an outer flow sleeve and connecting means (in the form of the connecting element) for connecting the inner flow sleeve 3 to the outer flow sleeve 4. However, in contrast to the previously disclosed embodiments, the outer flow sleeve is not adapted to be axially movable in relation to the coupling body. Instead it is adapted to be rotated around the central axis of the coupling body by the turning of the turning means as described above. The turning means are thus suitably provided on the outer surface of the first axial end portion 4*a* of the outer flow sleeve. The turning means may however be connected to the outer flow sleeve in other manners as long as the turning of the turning means also achieves a rotational movement of the outer flow sleeve.

The rotation of the outer flow sleeve around the central axis of the coupling body causes an axial movement of the inner flow sleeve. This is achieved by the slot 10*a* in the outer flow sleeve having an essentially S-shaped form in which the connecting element (such as a screw or the like) which is attached to the inner flow sleeve is allowed to run. The shape of the slot 10*a* need not be essentially S-shaped, however it should have a shape which causes the inner flow sleeve to move axially when the outer flow sleeve is rotated and thus should have a somewhat turned shape both in the axial extension and in the circumferential direction of the outer flow sleeve. The rotational movement of the outer flow sleeve may also be further controlled by arranging a threaded arrangement between a portion of a radial inner surface of the outer flow sleeve and for example a portion of a radial outer surface of the coupling body 2.

In order to ensure that the turning means cannot be turned around the central axis as described above unless a firm coupling to a male coupling body 36 of the male coupling 46 has been achieved, the turning means 35 may comprise a locking protrusion 39*a* adapted to be inserted into a locking groove 39*b* of the release sleeve 5 and can only be disengaged from the locking groove when the release sleeved has been axially moved towards the dispensing end of the dispensing gun such that a firm coupling of the dispensing gun to the male coupling body of a recipient has been achieved in the same manner as disclosed above.

As can be seen from FIG. 8*a*, when the dispensing gun has not yet been coupled to a male coupling 46 of a recipient, the turning means 35 is prevented from being turned in a direction around the central axis of the coupling body 2 by the locking arrangement comprising the locking protrusion 39*a* and the locking groove 39*b*. When the dispensing gun has been connected to the male coupling 46 by the axial movement of the retaining collar such that the locking elements fall down into a groove or the like of the male coupling body 36 and a retained in this position by the release sleeve having been axially moved towards the dispensing end of the dispensing gun, the turning means are released from the locking arrangement as the release sleeve has moved axially towards the dispensing end of the dispensing gun, as shown in FIG. 8*b*. When the turning means are turned in a direction around the central axis of the coupling body, the outer flow sleeve is rotated around said axis causing the connecting elements arranged in the slots and attached to the inner flow sleeve 3 to run from one end of the S-shaped slot 10*a* to the other end of the slot. By the attachment of the connecting element to the inner flow sleeve 3, the inner flow sleeve is forced to an axial movement in relation to the coupling body, thereby opening the poppet valve. FIG. 8*c* illustrates the dispensing gun when the poppet valve has been opened.

Figure 9:
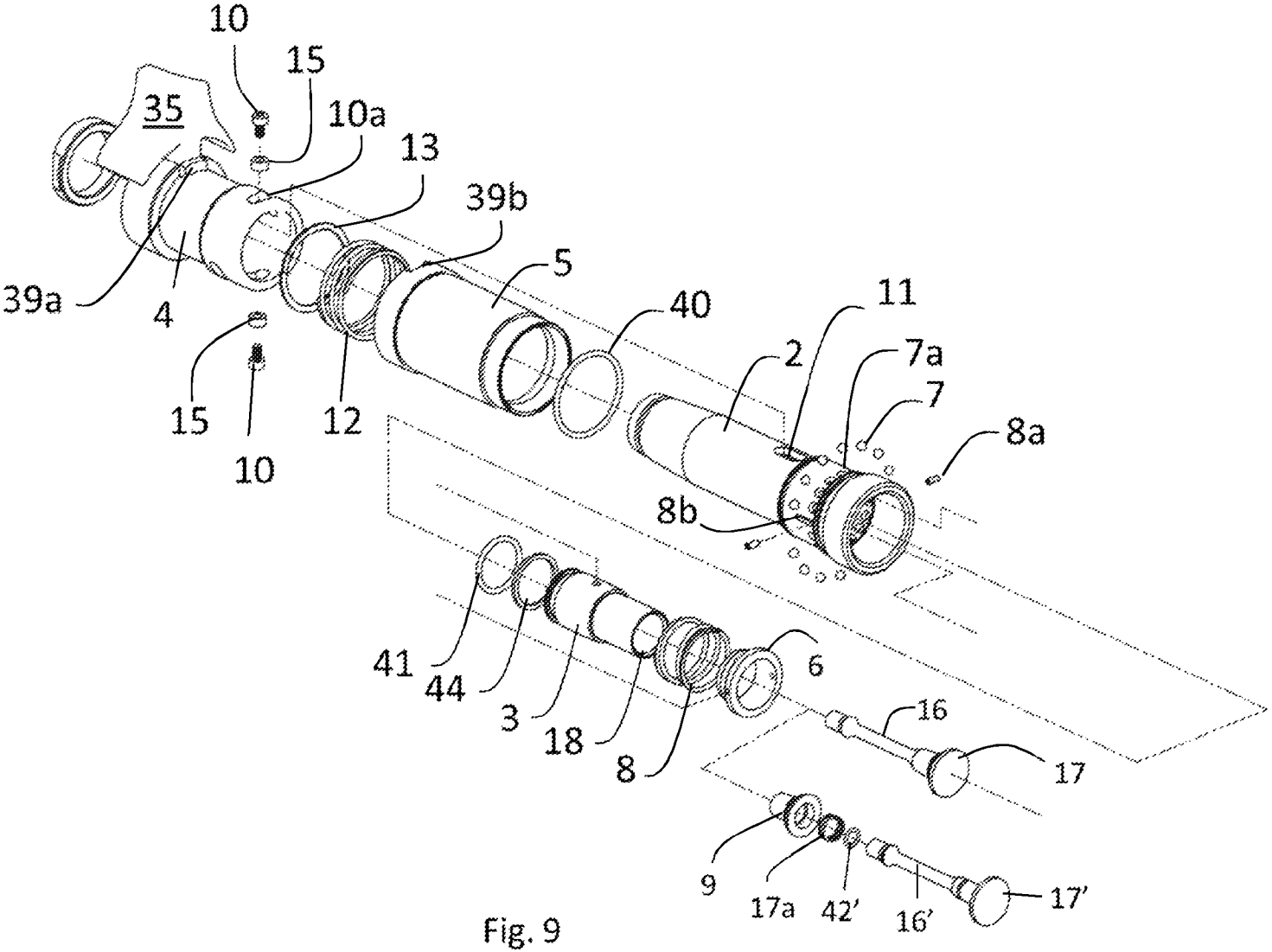
FIG. 9 is an exploded perspective view of the dispending gun according to the embodiment shown in FIGS. 8*a* to 8*c*.

FIG. 9 constitutes an exploded view of the dispensing gun as disclosed in FIGS. 8*a* to 8*c*. It also shows the two different embodiments of the poppet valve as disclosed above with reference to FIG. 4 and FIGS. 6*a* and 6*b*, both embodiments of the poppet valve being plausible in the same manner as previously disclosed.

The present invention is not limited to the specific embodiments disclosed and discussed with reference to the accompanying drawings, but may be varied within the scope of the claims. More specifically, even though the dispensing device has primarily been developed as a dispensing gun, especially a dispensing gun for dispensing liquids such as fuels, the invention can also be used in other dispensing applications. For example, the dispensing device could constitute a coupling part of a hydraulic coupling. Furthermore, the dispensing device is primarily developed for dispensing devices intended to be manually operated by a user for controlling the flow of the liquid to be dispensed. However, certain embodiments can also be used as dispensing devices which are not manually operated, as will be evident to the person skilled in the art.

Moreover, even though the embodiments shown in the figures and discussed above uses a poppet valve which is adapted to be opened and closed by means of movement of the inner flow sleeve (which forms the seat of the poppet valve), it is also possible to modify the dispensing device to use a poppet valve which is opened and closed by means of axial movement of the poppet valve stem and disc whereas the seat is stationary, without departing from the scope of the invention.

Furthermore, even though it is preferred that each of the inner flow sleeve, outer flow sleeve and the release sleeve are made in one piece, it is also possible to construct each of said sleeves from a plurality of sleeve sections together forming the sleeve if desired. Such a construction may for example in some cases facilitate the assembly of the dispensing device.

The dispensing device according to the present invention ensures that a liquid tight coupling to a recipient is achieved before the start of a dispensing procedure, and that the dispensing device cannot be released from the coupling as long as there is a flow of liquid through the outlet of the dispensing gun. Furthermore, at least the embodiments discussed with reference to the accompanying drawings, however not limited solely to a dispensing gun, also enable a flow control by the user using the dispensing device and the flow can be regulated during the dispensing operation as desired by the user.

The invention claimed is:

1. Dispensing device comprising:

a coupling body arranged at a dispensing end of the dispensing device, said coupling body being essentially rotational symmetrical around a central axis, an inner flow sleeve concentric with said central axis and arranged radially inside of the coupling body, a release sleeve concentric with said central axis and arranged radially outside of the coupling body, a poppet valve comprising a poppet valve stem and a poppet valve disc and wherein a first essentially axial end surface of the inner flow sleeve is adapted to serve as a valve seat for the poppet valve disc, at least one locking element arranged in a radial opening of the coupling body and in contact with a radial inner surface of the release sleeve, a retaining collar which is axially movable between at least a first and a second position in relation to the coupling body as well as axially movable in relation to the inner flow sleeve and guided on a radial outer surface of the inner flow sleeve, the retaining collar adapted to retain the locking element when in the first position and to allow movement of the locking element in the radial direction of the coupling body when in the second position, a mechanism for allowing axial movement of the release sleeve in relation to the coupling body in a direction towards the dispensing end of the dispensing device when the retaining collar is in the second position, wherein the poppet valve stem is attached to the coupling body and the dispensing device further comprises a mechanism for allowing axial movement of the inner flow sleeve in relation to the coupling body in a direction away from the dispensing end of the dispensing device when the retaining collar is in the second position, and wherein said mechanism for allowing axial movement of the inner flow sleeve in relation to the coupling body in a direction away from the dispensing end of the dispensing device comprises at least a connecting element or a link arm, said connecting element or link arm attached to the inner flow sleeve and extending through a radial slot of the coupling body.

2. Dispensing device according to claim 1, wherein said mechanism for allowing axial movement of the release sleeve in relation to the coupling body towards the dispensing end of the dispensing device when the retaining collar in the second position comprises a spring in one end fastened in relation to the coupling body, and in the other end cooperating with the release sleeve.

3. Dispensing device according to claim 1, wherein said mechanism for allowing axial movement of the inner flow sleeve in relation to the coupling body in a direction away from the dispensing end of the dispensing device comprises at least an outer flow sleeve arranged radially outside of the coupling body and cooperating with the inner flow sleeve by a connecting element.

4. Dispensing device according to claim 3, wherein the outer flow sleeve is adapted to move axially in relation to the coupling body to thereby axially move the inner flow sleeve in relation to the coupling body.

5. Dispensing device according to claim 3, wherein said mechanism for allowing axial movement of the inner flow sleeve in relation to the coupling body further comprises an actuator adapted to engage with the outer flow sleeve for allowing axial movement of the inner flow sleeve away from the dispensing end of the dispensing device, and adapted to not engage the outer flow sleeve when the retaining collar is in its first position.

6. Dispensing device according to claim 5, wherein the actuator in one end is connected to a flow control lever adapted to be operated by a user, the opposite end of the actuator adapted to engage the outer flow sleeve, and wherein the actuator is pivotably arranged.

7. Dispensing device according to claim 3, further comprising a release lever arm connected to the release sleeve and pivotable around a leverage point or leverage axis in response to an axial movement of the release sleeve.

8. Dispensing device according to claim 7, wherein said mechanism for allowing axial movement of the inner flow sleeve in relation to the coupling body further comprises an actuator adapted to engage with the outer flow sleeve for allowing axial movement of the inner flow sleeve away from the dispensing end of the dispensing device, and adapted to not engage the outer flow sleeve when the retaining collar is in its first position, and wherein the actuator is adapted to cooperate with the release lever arm such that when the release lever arm is pivoted around said leverage point or leverage axis the actuator is moved from a position in which it does not engage with the outer flow sleeve to a position where it engages the outer flow sleeve.

9. Dispensing device according to claim 8, wherein the actuator comprises a slot into which a tap of the release lever arm protrudes, and the actuator is adapted to pivot between a position wherein it engages the outer flow sleeve and a position where it does not engage the outer flow sleeve in response to a movement of the release lever arm.

10. Dispensing device according to claim 7, wherein said mechanism for allowing axial movement of the inner flow sleeve in relation to the coupling body further comprises an actuator adapted to engage with the outer flow sleeve for allowing axial movement of the inner flow sleeve away from the dispensing end of the dispensing device, and adapted to not engage the outer flow sleeve when the retaining collar is in its first position, and wherein the actuator is arranged such that it can engage the outer flow sleeve only when the release lever arm has been pivoted to a position where the release sleeve has been moved axially in relation to the coupling body towards the dispensing end of the dispensing device.

11. Dispensing device according to claim 7, further comprising a hooking element connected to the flow control lever and comprising an integrated spring to make it movable with the flow control lever, said hooking element adapted to cooperate with a hooking groove arranged in the release lever arm-to thereby provide a mechanism ensuring that the release sleeve is unable to be axially moved towards the dispensing end of the dispensing device when the flow control lever is an operative position.

12. Dispensing device according to claim 3, wherein the outer flow sleeve is adapted to rotate around the central axis to thereby axially move the inner flow sleeve in relation to the coupling body.

13. Dispensing device according to claim 12, further comprising a turning member adapted to be operated by a user and connected or attached to the outer flow sleeve to enable a rotation of the outer flow sleeve around the central axis when the turning member is turned in a direction around said central axis.

14. Dispensing device according to claim 13, wherein the turning member is prevented from being able to be turned in a direction around said central axis when the retaining collar is in its first position by means of a locking groove-arranged in an axial end of the release sleeve and cooperating with locking protrusion of the turning member.

15. Dispensing device according to claim 12 wherein the inner flow sleeve is connected with the outer flow sleeve by the connecting element, the connecting element also extending in at least one slot of the outer flow sleeve, and wherein said at least one slot in the outer flow sleeve is essentially S-shaped.

16. Dispensing device according to claim 1, wherein the dispensing device is a dispensing gun.

17. Dispensing device comprising:

a coupling body arranged at a dispensing end of the dispensing device, said coupling body being essentially rotational symmetrical around a central axis, an inner flow sleeve concentric with said central axis and arranged radially inside of the coupling body, a release sleeve concentric with said central axis and arranged radially outside of the coupling body, a poppet valve comprising a poppet valve stem and a poppet valve disc, and wherein a first essentially axial end surface of the inner flow sleeve is adapted to serve as a valve seat for the poppet valve disc, at least one locking element arranged in a radial opening of the coupling body and in contact with a radial inner surface of the release sleeve, a retaining collar which is axially movable between at least a first and a second position in relation to the coupling body as well as axially movable in relation to the inner flow sleeve and guided on a radial outer surface of the inner flow sleeve, the retaining collar adapted to retain the locking element when in the first position and to allow movement of the locking element in the radial direction of the coupling body when in the second position, a mechanism for allowing axial movement of the release sleeve in relation to the coupling body in a direction towards the dispensing end of the dispensing device when the retaining collar is in the second position, and wherein the poppet valve stem and poppet valve disc are arranged to be axially movable in relation to the coupling body.

18. Dispensing device according to claim 17, wherein the dispensing device is a dispensing gun.

* * * * *